US011127241B2

(12) United States Patent
Mohammed et al.

(10) Patent No.: US 11,127,241 B2
(45) Date of Patent: Sep. 21, 2021

(54) DELIVERY DOOR FOR AUTOMATIC FROZEN FOOD PRODUCT VENDING MACHINE

(71) Applicant: The Vollrath Company, L.L.C., Sheboygan, WI (US)

(72) Inventors: Aamer Mohammed, Manitowoc, WI (US); Ken Wetenkamp, Plymouth, WI (US)

(73) Assignee: The Vollrath Company, L.L.C., Sheboygan, WI (US)

( * ) Notice: Subject to any disclaimer, the term of this patent is extended or adjusted under 35 U.S.C. 154(b) by 0 days.

(21) Appl. No.: 16/292,028

(22) Filed: Mar. 4, 2019

(65) Prior Publication Data

US 2019/0272699 A1 Sep. 5, 2019

Related U.S. Application Data

(60) Provisional application No. 62/638,710, filed on Mar. 5, 2018.

(51) Int. Cl.

| | |
|---|---|
| ***G07F 13/10*** | (2006.01) |
| ***G07F 11/00*** | (2006.01) |
| ***G07F 17/00*** | (2006.01) |
| ***G07F 9/00*** | (2006.01) |
| *G07F 13/02* | (2006.01) |
| *G07F 9/10* | (2006.01) |

(52) U.S. Cl.

CPC ..... *G07F 13/10* (2013.01); *G07F 9/002* (2020.05); *G07F 11/007* (2013.01); *G07F 17/0071* (2013.01); *G07F 9/105* (2013.01); *G07F 13/02* (2013.01)

(58) Field of Classification Search

USPC ..... 221/150 R, 150 HC

See application file for complete search history.

(56) References Cited

U.S. PATENT DOCUMENTS

| | | | |
|---|---|---|---|
| D111,772 | S | 10/1938 | Kettleborough |
| 2,663,482 | A | 12/1953 | Gilberty |

(Continued)

FOREIGN PATENT DOCUMENTS

| | | | |
|---|---|---|---|
| CN | 1141128 | A | 1/1997 |
| CN | 1283163 | A | 2/2001 |

(Continued)

OTHER PUBLICATIONS

International Search Report and Written Opinion in International Application No. PCT/US2019/020591, dated May 24, 2019. (13 pages).

(Continued)

*Primary Examiner* — Gene O Crawford
*Assistant Examiner* — Ayodeji T Ojofeitimi
(74) *Attorney, Agent, or Firm* — Foley & Lardner LLP

(57) ABSTRACT

An automatic frozen food product vending machine includes a frozen food product dispensing station for dispensing at least one frozen food product into a frozen food container, an arm movable to transfer the dispensed frozen food product container to a user access platform, and a user access door located adjacent to the user access platform. The user access door is configured to be vertically driven between a closed position and an open position.

21 Claims, 28 Drawing Sheets

(56) References Cited

U.S. PATENT DOCUMENTS 3,124,916 A 3/1964 Anderson et al.
3,276,633 A 10/1966 Rahauser
3,318,428 A 5/1967 Klein
3,554,364 A 1/1971 Lane et al.
3,638,392 A 2/1972 Welker et al.
3,863,724 A 2/1975 Dalia, Jr.
4,009,740 A 3/1977 Michielli
4,098,384 A 7/1978 Kovar
4,174,742 A 11/1979 Murphey
4,186,768 A 2/1980 Kuester
4,188,768 A 2/1980 Getman
4,226,269 A 10/1980 Carr et al.
4,232,798 A 11/1980 Hammel et al.
4,378,164 A 3/1983 Manfroni
4,388,795 A 6/1983 Stohlquist et al.
4,417,610 A 11/1983 Waldstrom et al.
4,446,896 A 5/1984 Campagna
4,469,150 A 9/1984 Grimaldi
4,518,021 A 5/1985 Copas et al.
4,645,093 A 2/1987 Jones
4,953,751 A 9/1990 Shannon
5,009,330 A 4/1991 Young et al.
5,025,840 A 6/1991 Tacke
5,027,698 A 7/1991 Chirnomas
5,105,978 A * 4/1992 Trouteaud ..... G07F 9/02 221/150 R
5,148,905 A 9/1992 Tacke et al.
5,350,082 A 9/1994 Kiriakides et al.
5,353,904 A 10/1994 Tacke et al.
5,382,090 A 1/1995 Cocchi
5,400,614 A 3/1995 Feola
5,404,797 A 4/1995 Millar
D358,427 S 5/1995 Gobindram
5,450,980 A 9/1995 Laidlaw
5,491,333 A 2/1996 Skell et al.
5,516,002 A * 5/1996 Morillo ..... G07F 11/64 221/150 HC
5,575,066 A 11/1996 Cocchi
5,603,229 A 2/1997 Cocchi et al.
5,615,952 A 4/1997 Cocchi
5,653,118 A 8/1997 Cocchi et al.
5,671,662 A 9/1997 Cocchi et al.
5,727,609 A 3/1998 Knight et al.
5,823,392 A 10/1998 Madico
5,957,040 A 9/1999 Feola
6,082,419 A 7/2000 Skell et al.
6,102,246 A 8/2000 Goulet et al.
6,112,539 A 9/2000 Colberg
6,238,180 B1 5/2001 Magoshi et al.
6,253,955 B1 * 7/2001 Bower ..... G07F 11/14 221/150 R
6,264,066 B1 7/2001 Vincent et al.
6,304,796 B1 10/2001 Ding
6,305,573 B1 10/2001 Fritze et al.
6,325,250 B1 12/2001 Feola
6,389,962 B1 5/2002 Han et al.
6,390,334 B1 5/2002 Kim et al.
6,424,884 B1 7/2002 Brooke et al.
6,485,768 B2 11/2002 Feola
6,598,758 B2 7/2003 Kim et al.
6,698,228 B2 3/2004 Kateman et al.
6,723,361 B2 4/2004 Feola
6,745,593 B2 6/2004 Cocchi et al.
6,907,743 B2 6/2005 Cocchi et al.
7,013,932 B2 3/2006 Berghoff et al.
7,036,724 B2 5/2006 Lealao et al.
7,204,360 B2 4/2007 Rasmussen
7,264,156 B2 9/2007 Lealao et al.
7,299,109 B2 11/2007 Juds et al.
7,428,824 B1 9/2008 Malachowsky et al.
7,448,516 B2 11/2008 Davis et al.
7,476,353 B2 1/2009 Cocchi et al.
7,750,817 B2 7/2010 Teller
7,756,604 B1 7/2010 Davis et al.
7,762,181 B2 7/2010 Boland et al.
7,815,954 B2 10/2010 Miller et al.
7,845,375 B2 12/2010 Dorney
7,885,520 B2 2/2011 Stettes
7,896,038 B2 3/2011 Jones et al.
7,899,713 B2 3/2011 Rothschild
8,091,374 B2 1/2012 Chang
8,245,735 B2 8/2012 Chase et al.
8,297,182 B2 10/2012 Cocchi et al.
8,335,587 B2 12/2012 Feola
8,404,166 B2 3/2013 Cocchi et al.
8,479,532 B2 7/2013 Cocchi et al.
8,496,141 B2 7/2013 McKay et al.
8,579,155 B2 11/2013 Malachowsky et al.
8,591,097 B2 11/2013 Cocchi et al.
8,739,565 B2 6/2014 Cocchi et al.
8,746,295 B2 6/2014 Mueller et al.
8,869,540 B2 10/2014 Cocchi et al.
8,944,289 B2 2/2015 Cocchi et al.
8,948,912 B2 2/2015 Nakamoto et al.
8,978,931 B2 3/2015 Cocchi et al.
8,989,893 B2 * 3/2015 Jones ..... A23G 9/22 700/234
9,259,016 B2 2/2016 Mohammed et al.
9,635,874 B2 5/2017 Bruckner et al.
9,764,880 B2 9/2017 Hundley et al.
D834,092 S 11/2018 Bruckner et al.
10,188,128 B2 1/2019 Bruckner et al.
10,448,656 B2 10/2019 Wetenkamp
2002/0036027 A1 3/2002 Kondo et al.
2002/0040915 A1 4/2002 Kim et al.
2002/0077724 A1 * 6/2002 Paulucci ..... G06Q 20/20 700/231
2002/0113078 A1 8/2002 Kim et al.
2004/0178213 A1 * 9/2004 Martinelli ..... G07F 11/54 221/150 R
2004/0251270 A1 12/2004 Davis et al.
2005/0263536 A1 12/2005 Selfridge et al.
2007/0062981 A1 3/2007 Cocchi et al.
2007/0199614 A1 8/2007 Cocchi et al.
2007/0210105 A1 9/2007 Malachowsky et al.
2007/0254084 A1 11/2007 Cocchi et al.
2007/0267087 A1 11/2007 Jones et al.
2008/0073376 A1 3/2008 Gist et al.
2008/0093383 A1 4/2008 Harra
2008/0153567 A1 6/2008 Juds et al.
2009/0007984 A1 1/2009 Nuriely
2009/0139257 A1 6/2009 Cocchi et al.
2009/0157505 A1 6/2009 Yokoyama
2009/0238931 A1 9/2009 Herrick et al.
2009/0293733 A1 12/2009 Martin et al.
2010/0062128 A1 3/2010 Khoo et al.
2010/0101235 A1 4/2010 Cocchi et al.
2010/0102078 A1 * 4/2010 Mosey ..... G07F 9/105 221/115
2010/0122539 A1 5/2010 Cocchi et al.
2010/0125362 A1 5/2010 Canora et al.
2011/0006079 A1 1/2011 McKay et al.
2011/0011887 A1 1/2011 Zaniboni et al.
2011/0101039 A1 5/2011 Cocchi et al.
2011/0108569 A1 5/2011 Jones et al.
2011/0256617 A1 10/2011 Cocchi et al.
2011/0271690 A1 11/2011 Cocchi et al.
2012/0017606 A1 1/2012 Cocchi et al.
2012/0103201 A1 5/2012 Cocchi et al.
2012/0227420 A1 9/2012 Soderman
2012/0251697 A1 10/2012 Cocchi et al.
2013/0000338 A1 1/2013 Cocchi et al.
2013/0014650 A1 1/2013 Cocchi et al.
2013/0103198 A1 4/2013 Nakamoto et al.
2013/0269381 A1 10/2013 Cocchi et al.
2013/0269540 A1 10/2013 Cocchi et al.
2014/0120235 A1 5/2014 Jones et al.
2014/0212559 A1 7/2014 Cocchi et al.
2014/0261873 A1 9/2014 Mohammed et al.
2014/0295044 A1 10/2014 Cocchi et al.
2014/0335250 A1 11/2014 Cocchi et al.
2014/0348999 A1 11/2014 Cocchi et al.
2014/0356494 A1 12/2014 Cocchi et al.
2015/0044331 A1 2/2015 Cocchi et al.

(56) References Cited

U.S. PATENT DOCUMENTS

| | | | |
|---|---|---|---|
| 2015/0060488 | A1 | 3/2015 | Rupp |
| 2015/0216201 | A1 | 8/2015 | Bruckner et al. |
| 2016/0044936 | A1 | 2/2016 | Tollefson et al. |
| 2017/0143000 | A1 | 5/2017 | Bruckner et al. |
| 2017/0225853 | A1 | 8/2017 | Hundley et al. |
| 2017/0334617 | A1 | 11/2017 | Hundley et al. |
| 2019/0272699 | A1 | 9/2019 | Mohammed et al. |

FOREIGN PATENT DOCUMENTS

| | | | |
|---|---|---|---|
| EP | 0 596 722 | | 5/1994 |
| EP | 1 450 318 | A2 | 8/2004 |
| EP | 1 829 453 | | 6/2011 |
| EP | 2 197 291 | | 11/2011 |
| JP | 2009-278983 | A | 12/2009 |
| KR | 20-0203220 | | 11/2000 |
| KR | 20-0231268 | | 7/2001 |
| KR | 20030060379 | | 7/2003 |
| WO | WO-2007/090165 | A2 | 8/2007 |
| WO | WO-2012/007773 | A2 | 1/2012 |
| WO | WO-2016/168273 | A1 | 10/2016 |

OTHER PUBLICATIONS

Carpigiani—Applicare Targa Caratteristiche Instructions Handbook, 191 P/SP Magica USA, 191 P/SP Magica Colore PP USA, distributed Sep. 1, 2011,50 pages.

International Search Report and Written Opinion for PCT Application PCT/US2014/017044, dated May 27, 2014, 11 pages.

International Search Report and Written Opinion, PCT/US2016/027251, PW Stoelting, L.L.C., 13 pages (dated Jun. 30, 2016).

PCT-2012/007773.

* cited by examiner

DELIVERY DOOR FOR AUTOMATIC FROZEN FOOD PRODUCT VENDING MACHINE

CROSS-REFERENCE TO RELATED PATENT APPLICATION

This application claims the benefit of and priority to U.S. Patent Application No. 62/638,710 filed Mar. 5, 2018, the entire disclosure of which is incorporated by reference herein.

BACKGROUND

The present invention relates generally to the field of automatic vending machines and, in particular, to the control and automation of frozen food product vending machines.

Frozen food product dispensing machines are used to dispense soft confectionary products such as aerated ice cream, custard, frozen yogurt, sherbets, sorbets, or other similar frozen food products. Most of these dispensing machines are designed similarly and operate in a similar manner. A storage hopper, reservoir, or bag holds a liquid form of the desired dessert product. Air and the liquid are drawn into a freezing chamber where they are mixed and cooled to form the aerated frozen product that is commonly referred to as a "soft-serve" frozen food product.

SUMMARY

One embodiment of the invention relates to an automatic frozen food product vending machine. The machine includes a frozen food product dispensing station for dispensing a frozen food product into a frozen food product container. The machine further includes an arm movable to transfer the dispensed food product container to a user access platform, and a user access door located adjacent to the user access platform and configured to be vertically driven between a closed position and an open position.

Another embodiment of the invention relates to a delivery door system for use with a vending machine. The delivery door system includes a user access platform and a user access door located adjacent to the user access platform. The user access door is configured to be vertically driven between a closed position and an open position.

BRIEF DESCRIPTION OF THE DRAWINGS

The invention will become more fully understood from the following detailed description, taken in conjunction with the accompanying drawings, in which.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Figure 1:
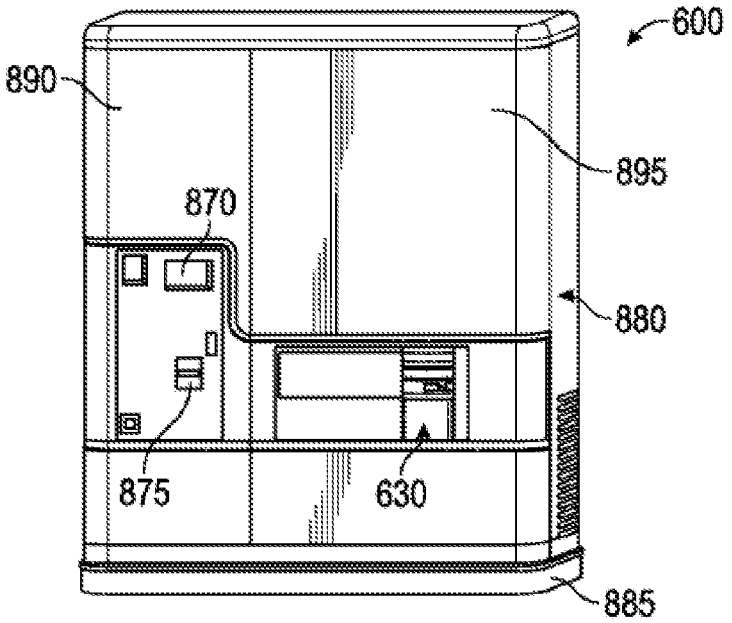
FIG. 1 is a perspective view of an automatic frozen food product vending machine according to an exemplary embodiment.
Figure 2:
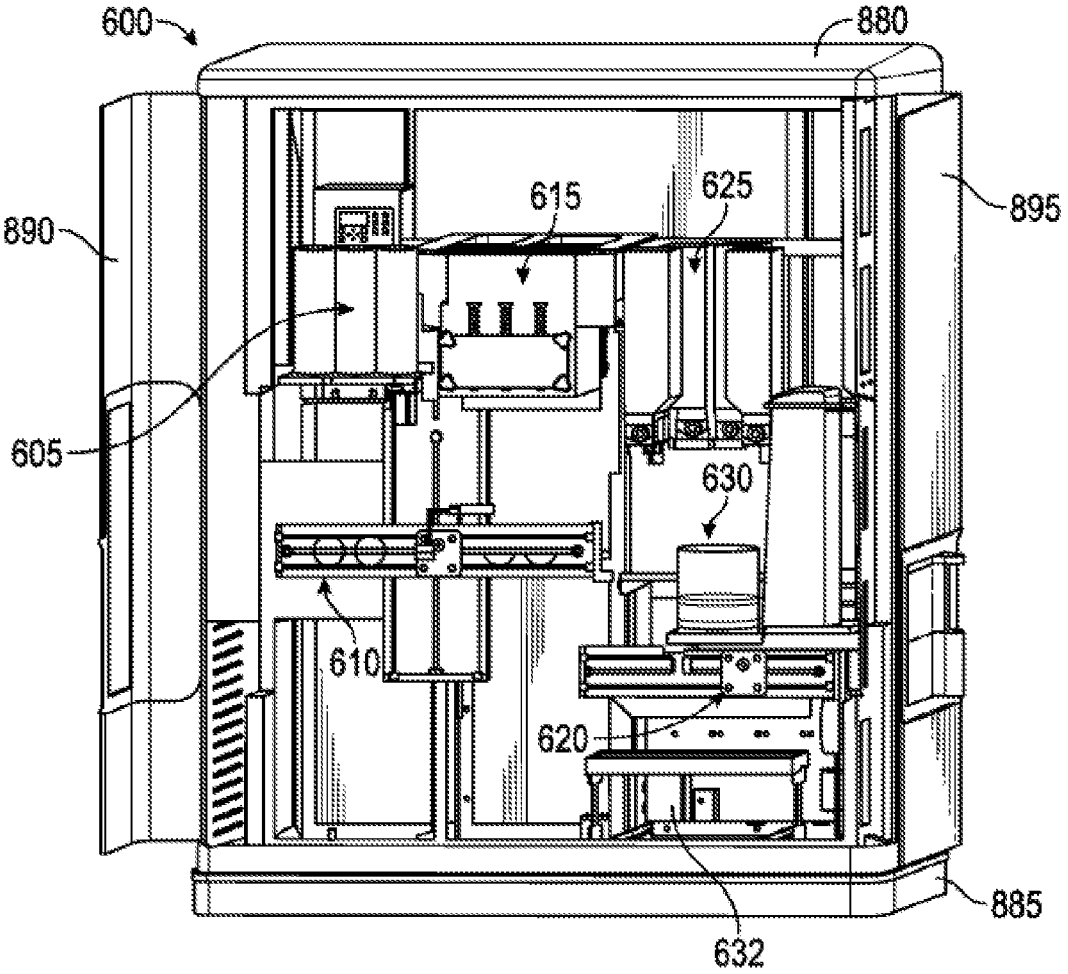
FIG. 2 is a perspective view of the vending machine of FIG. 1 with access doors open.
Figure 3:
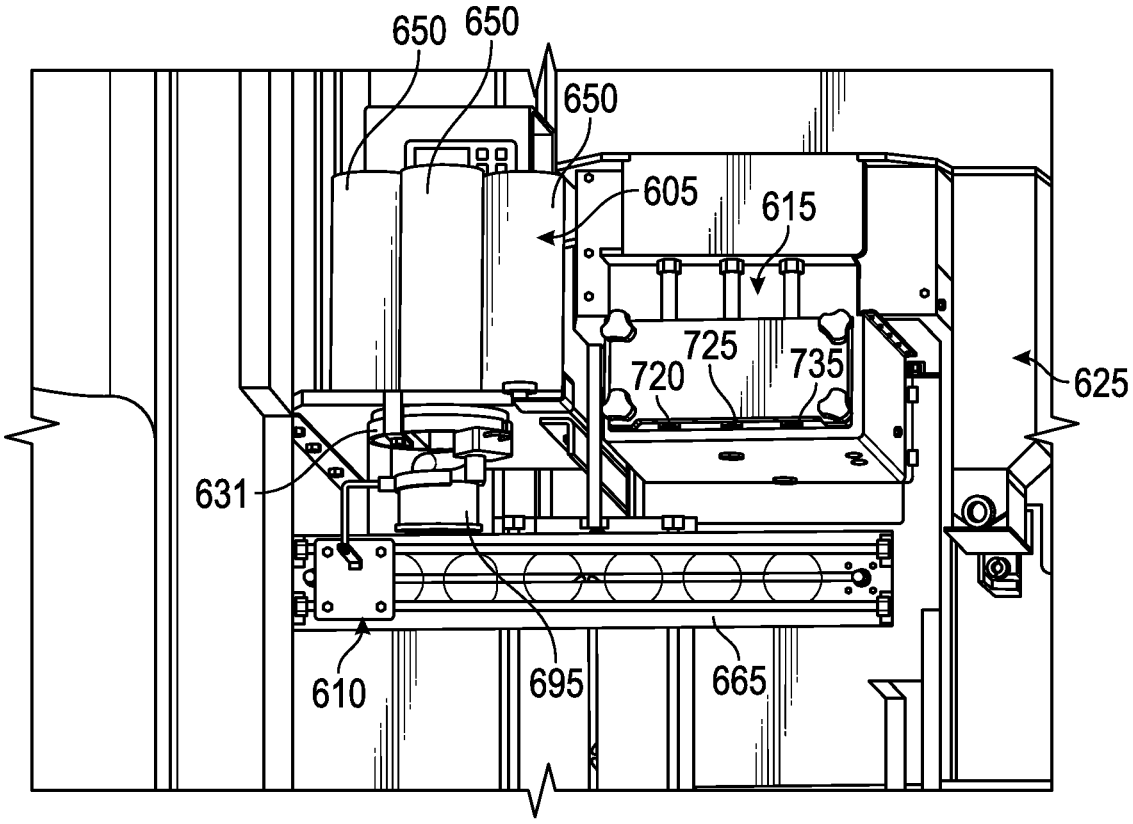
FIG. 3 is a perspective view of a portion of the vending machine of FIG. 1.
Figure 5:
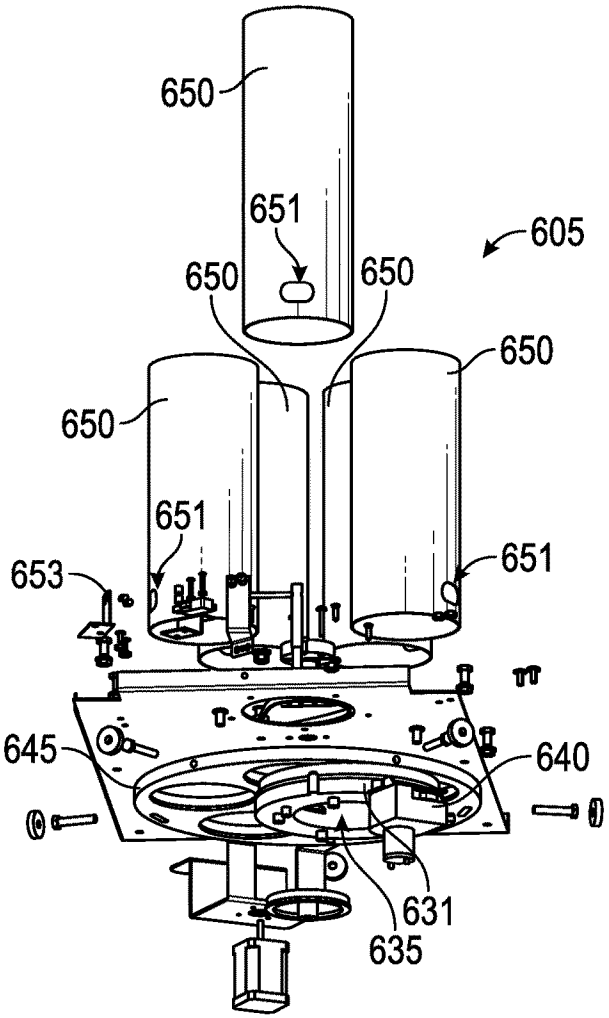
FIG. 5 is an exploded view of the container dispenser of FIG. 4.
Figure 4:
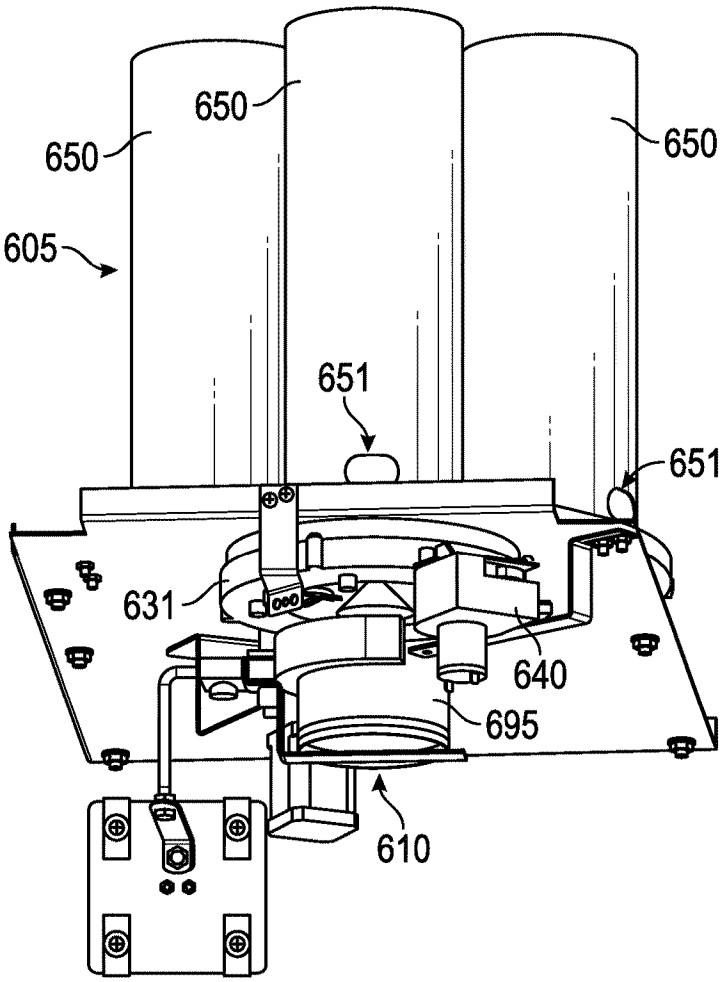
FIG. 4 is a perspective view of a container dispenser of the vending machine of FIG. 1.
Figure 6:
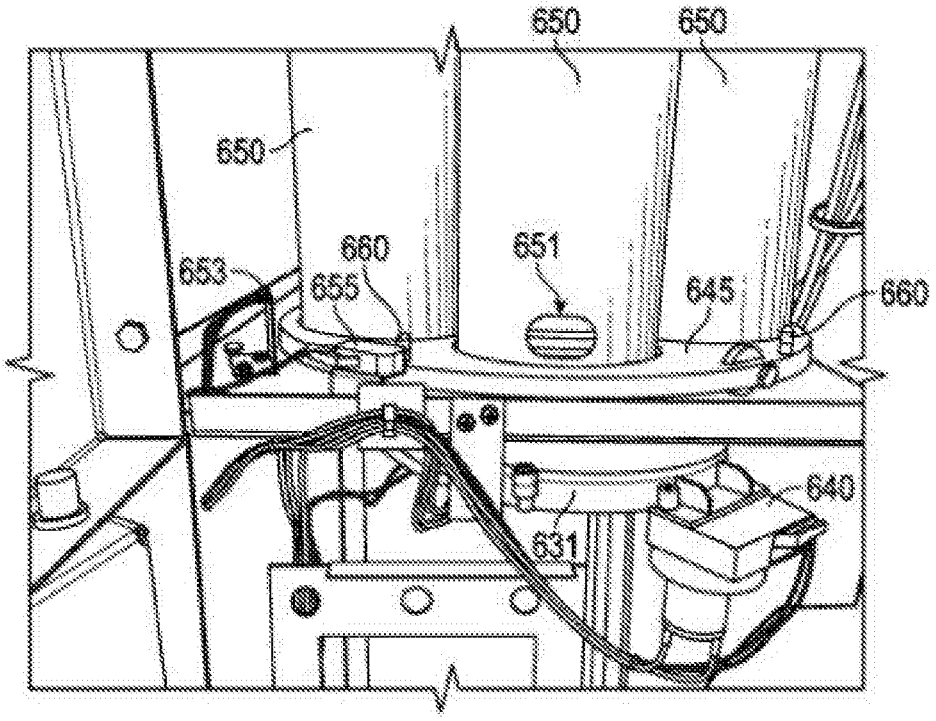
FIG. 6 is a perspective view of a portion of the vending machine of FIG. 1.

Referring to FIGS. 1-21 an automated or automatic frozen food product vending machine 600 is illustrated according to an exemplary embodiment. Referring to FIGS. 1-2, vending machine 600 includes a container dispenser 605, a first movable platform 610, a frozen food product dispensing station 615, a second movable platform 620, a topping dispensing station 625, a user access station 630, and processing electronics 632 configured or programmed to control operation of vending machine 600.

Referring to FIGS. 3-6, container dispenser 605 is configured to store and dispense frozen food product containers a single container at a time. Containers include cups, dishes, cones, bowls, and other containers suitable for containing a frozen food product. In some embodiments, container dispenser 605 provides a single type of container in a size. In other embodiments, container dispenser 605 provides containers of different types and or sizes.

Container dispenser 605 includes a dispense mechanism 631 configured to dispense a single container at a time. Dispense mechanism 631 includes a dispense opening 635 through which containers are dispensed. In some embodiments, a system of cams support and release a single container at a time through the dispense opening 635 with the system of cams driven by a motor 640 or other appropriate actuator. Container dispenser 605 includes a rotating carousel 645. Carousel 645 supports multiple container sleeves 650. As illustrated, container dispenser 605 includes five container sleeves 650. In some embodiments, more or fewer container sleeves 650 are included. In some embodiments, only a single container sleeve is provided and carousel 645 is omitted. Each container sleeve 650 supports a stack of containers. Each container sleeve 650 includes an opening 651 that can be aligned with a container presence sensor 653 (e.g., a photoelectric sensor, laser sensor, etc.) configured to detect when a container is present at opening 651. Carousel 645 rotates so that one of the container sleeves 650 is aligned with the dispense opening 635 of dispense mechanism 631. A sleeve presence sensor 655 is used to detect when one of the container sleeves 650 is aligned with the dispense opening 650. As illustrated, presence sensor 655 is a limit switch that is contacted by a post 660 associated with each of the container sleeves 650. As carousel 645 rotates, post 660 contacts the limit switch 655 indicating that the container sleeve 650 associated with the post 660 is aligned with dispense opening 635. Processing electronics 632 described in more detail below, may be configured to track the quantity of containers remaining in each container sleeve 650 and cause carousel 645 to rotate when the active container sleeve 650 (i.e., the container sleeve 650 aligned with dispense opening 635) is empty (i.e., has no more containers) to move an inactive container sleeve 650 (i.e., one of the container sleeves 650 not aligned with dispense opening 635) that is stocked with containers (i.e., contains one or more containers) into the active position. In some embodiments, each container sleeve 650 is stocked with containers of the same size and type. In some embodiments, each container sleeve 650 is stocked with containers of different sizes and/or types. Processing electronics 632 may be configured to track size, type, and quantity of containers stored in each container sleeve 650 and rotate the appropriate container sleeve 650 into the active position to dispense the desired size and/or type of container. Processing electronics 632 may be configured to receive an input from container presence sensor 653 to determine if a container is present to be dispensed from container sleeve 605 or if container sleeve 650 is empty. Processing electronics 632 may be configured to operate dispense mechanism 631 (e.g., by activating motor 640 for the appropriate period of time or number of steps) to dispense a single container from the container sleeve 650 in the active position.

Referring to FIGS. 3 and 7-11, first movable platform 610 is configured to receive and support a dispensed container from container dispenser 605, move the dispensed container as necessary to receive the selected type and amount of frozen food product from frozen food product dispensing station 615, and move the dispensed container containing the dispensed frozen food product to transfer the dispensed container containing the dispensed frozen food product to second movable platform 620 for further handling. In some embodiments, only one movable platform is provided and the single movable platform is configured to receive and support a dispensed container from container dispenser 605, move the dispensed container as necessary to receive the selected type and amount of frozen food product from frozen food product dispensing station 615, move the dispensed container containing the dispensed frozen food product as necessary to receive the selected type and amount of one or more toppings from topping dispensing station 625, and move the dispensed container containing the dispensed frozen food product and toppings to a position to be transferred to user access station 630 or move transfer the dispensed container containing the dispensed frozen food product and toppings to a position for access and removal by a user.

In some embodiments, first movable platform 610 is similar to movable platform 160 as described above. First movable platform 610 is connected to a gantry 665 similar to gantry 165 described above. First movable platform 610 includes a base 670 and a support platform 675 attached to base 670. Support platform 675 includes an arm 680 and a grip portion 685. Arm 680 is L-shaped and includes a lower support 690 for supporting the bottom of a dispensed container 695. Grip portion 685 includes a fixed portion 700, which is shown as a substantially C-shaped wall, and a movable arm 705. Fixed portion 700 and movable arm 705 contact the sides of dispensed container 695 to position and secure dispensed container 695 on support platform 675. Movable arm 705 is movable between an open position in which a container may be removed from support platform 675 and a closed position in which container is secured to the support platform 675. A spring 710 biases movable arm 705 to the closed position. Arm 705 may be moved to the open position by causing first movable platform 610 to move in such a way that the arm 705 is contacted by a post or finger and movement of first movable platform 610 relative to the post causes arm 705 to move. Such a post may be received within a curve 715 formed in movable arm 705. First movable platform 610 may also include a weight sensor 720. Weight sensor 720 may be used to detect the presence of dispensed container 695 on support platform 675, the amount of frozen food product dispensed into dispensed container 695, and the amount of topping dispensed into dispensed container 695. In some embodiments, weight sensor 720 includes a strain gauge coupled to arm 680. As arm 680 moves relative to base 670, the strain gauge deforms, which is used to provide an input indicative of the weight of dispensed container, frozen food product, or toppings to processing electronics 632.

Figure 7:
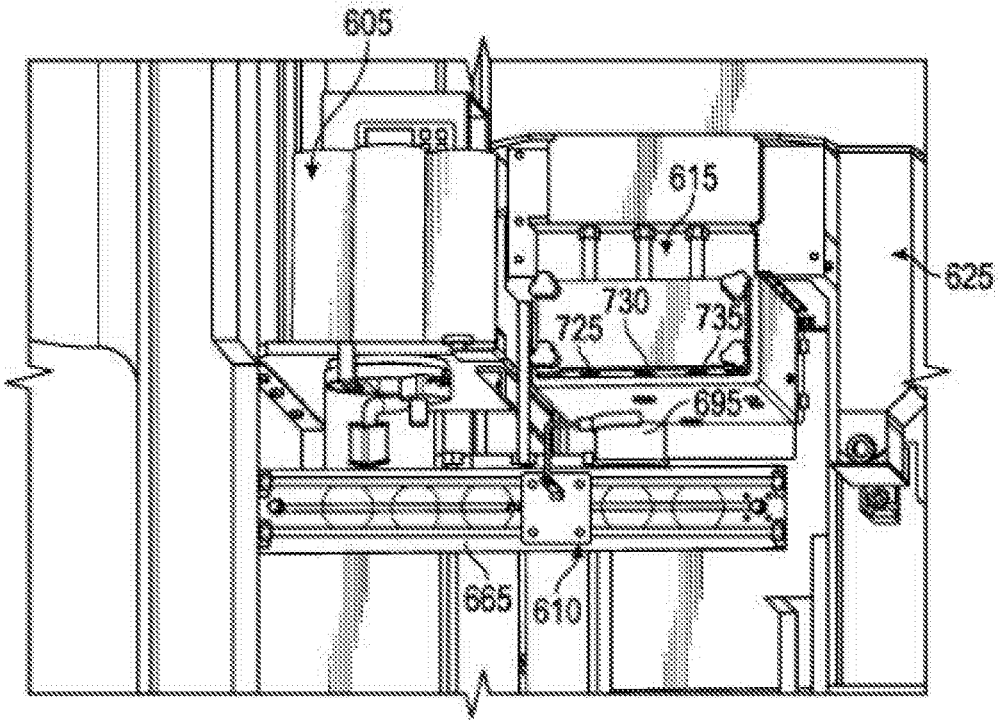
FIG. 7 is a perspective view of a portion of the vending machine of FIG. 1.
Figure 8:
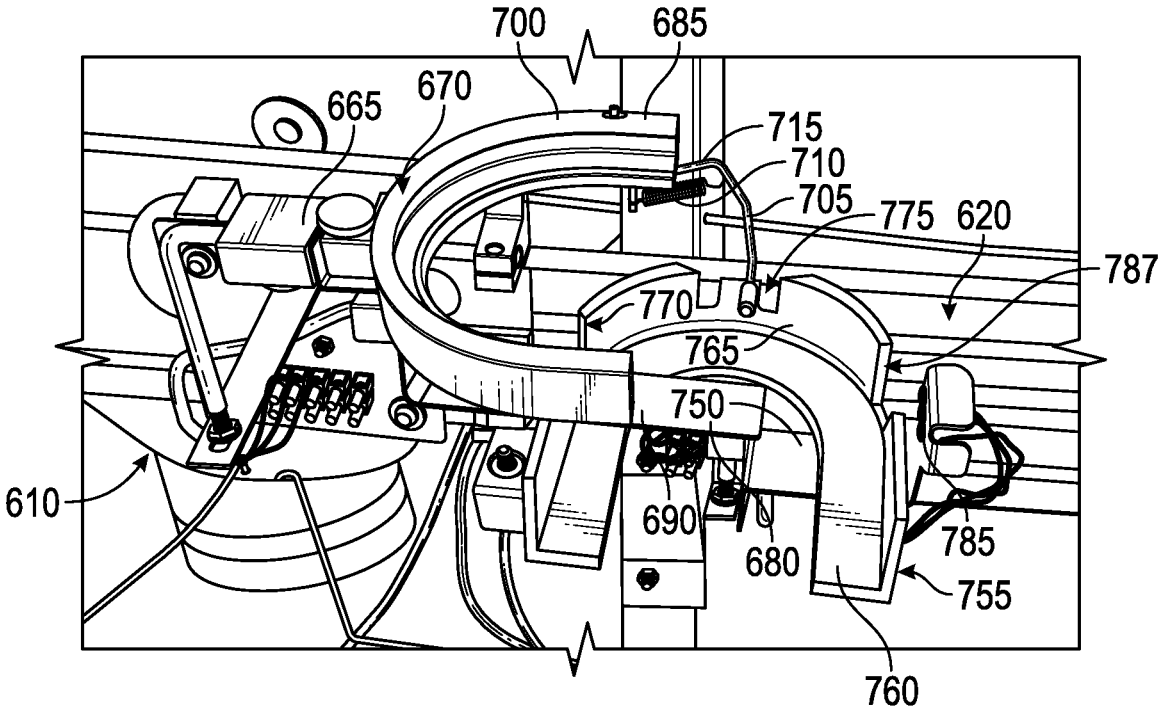
FIG. 8 is a perspective view of a portion of the vending machine of FIG. 1.
Figure 9:
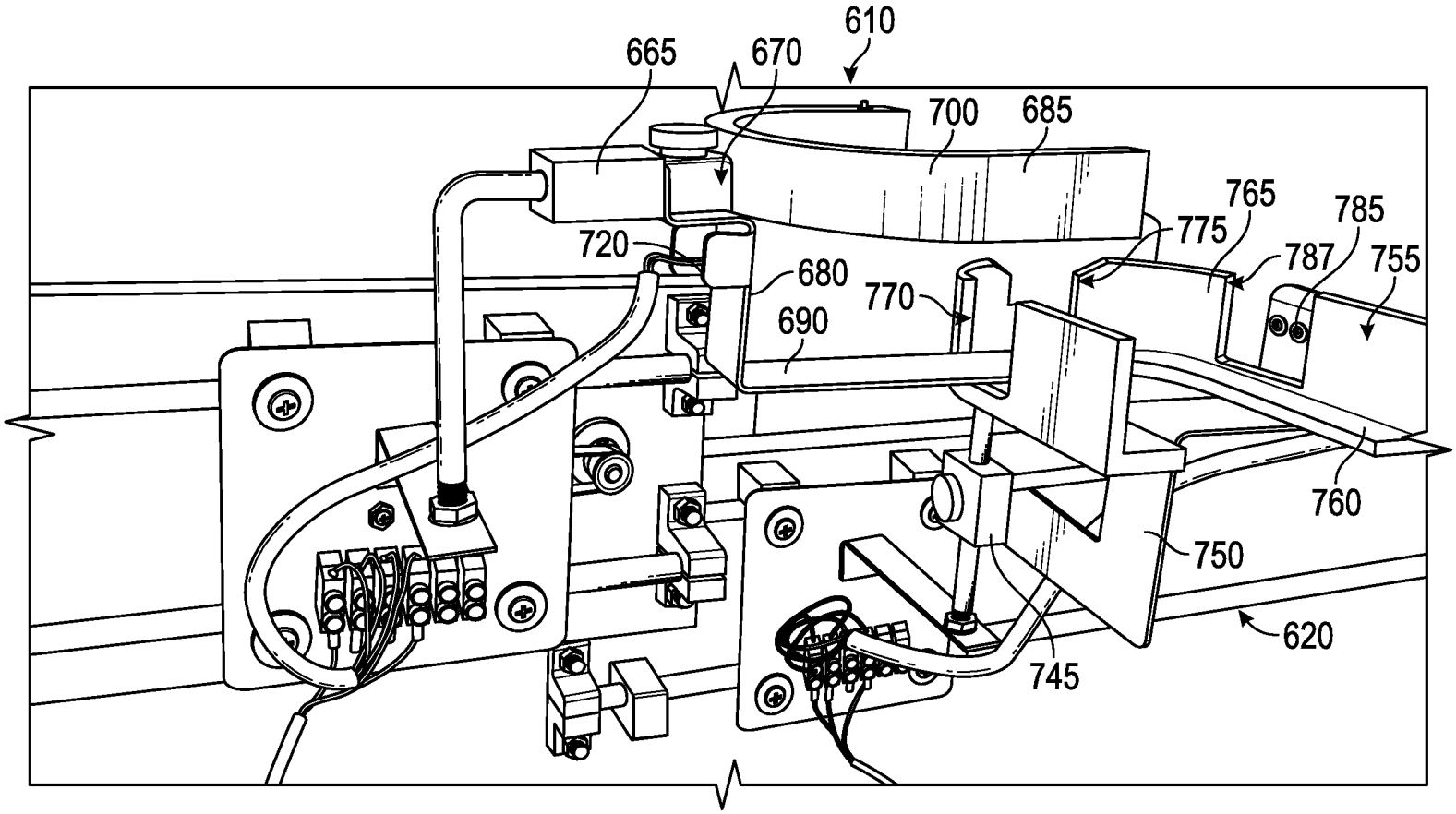
FIG. 9 is a perspective view of a portion of the vending machine of FIG. 1.
Figure 10:
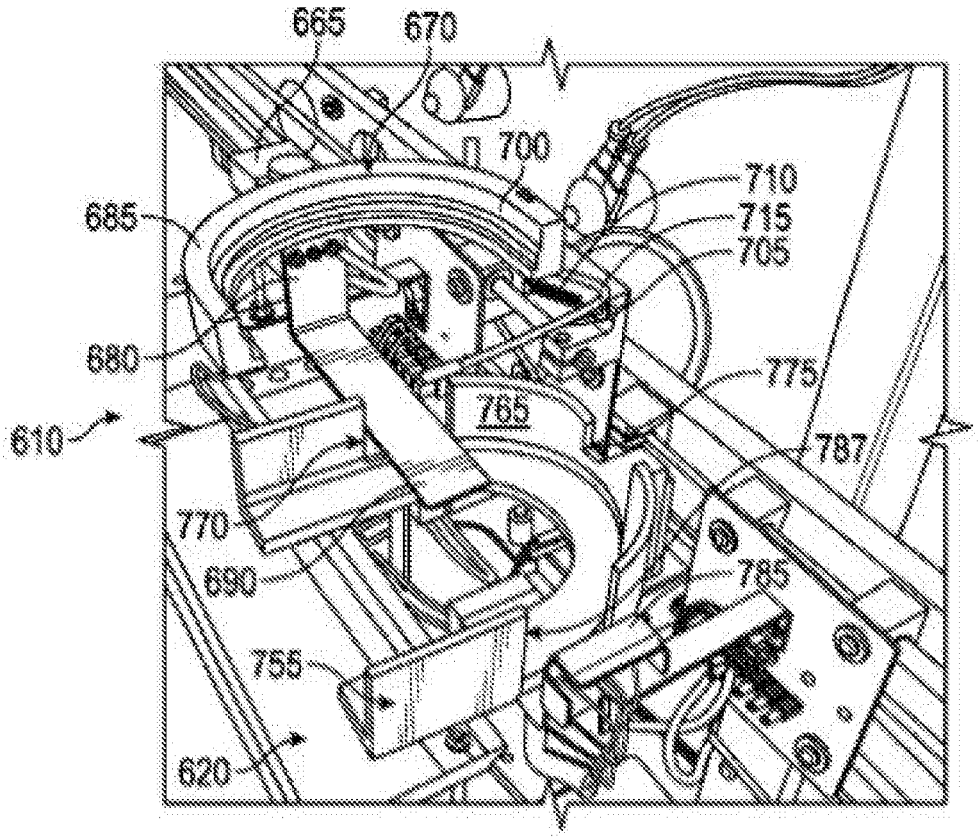
FIG. 10 is a perspective view of a portion of the vending machine of FIG. 1.
Figure 11:
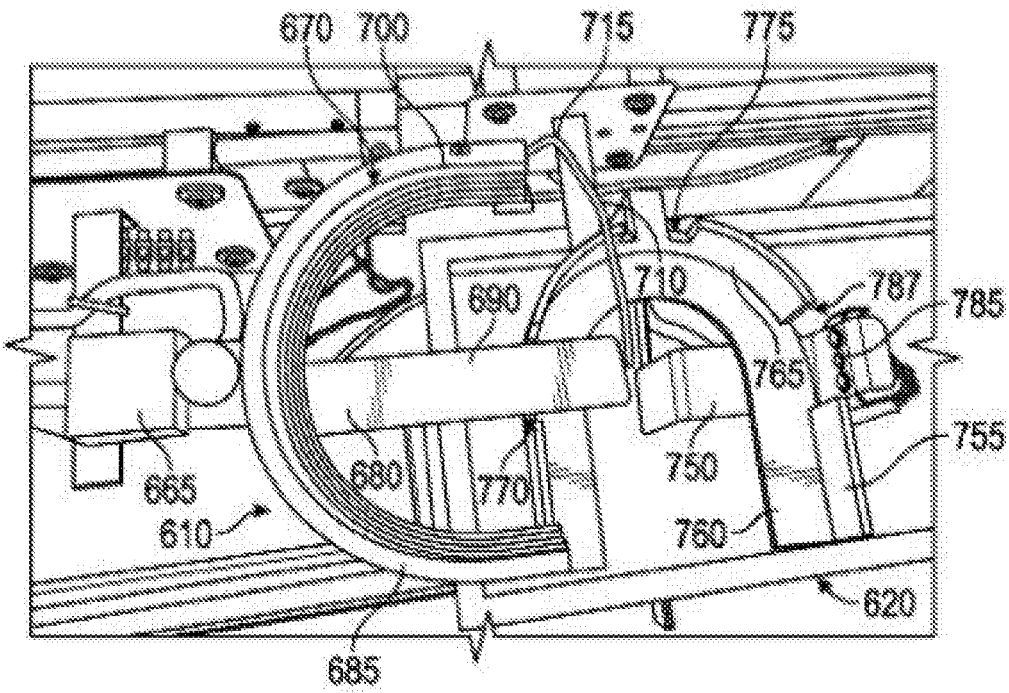
FIG. 11 is a perspective view of a portion of the vending machine of FIG. 1.
Figure 12:
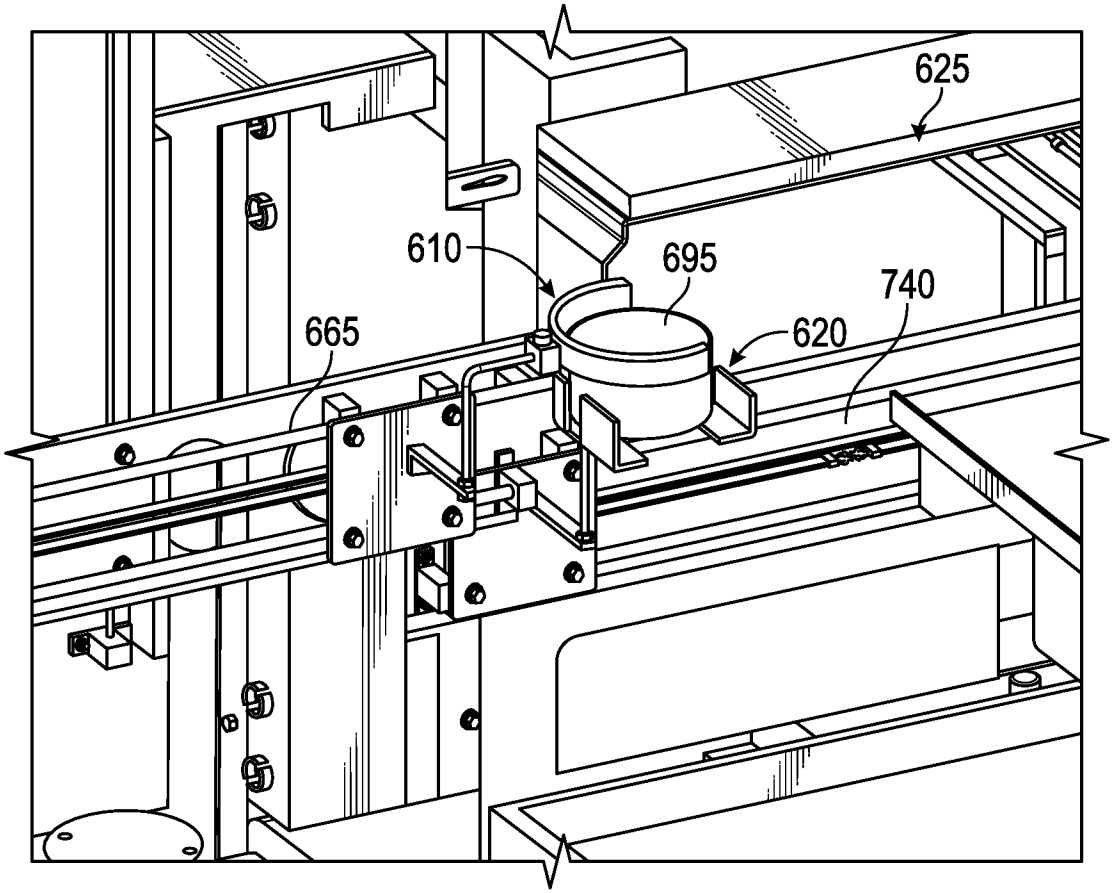
FIG. 12 is a perspective view of a portion of the vending machine of FIG. 1.

Referring to FIG. 7, frozen food product dispensing station 615 is configured to dispense at least one frozen food product. Different types of frozen food products include distinct food products (e.g., ice cream, custard, frozen yogurt, sherbets, sorbets, or other similar frozen food products) and/or distinct flavors of a frozen food product (e.g., vanilla, chocolate, strawberry, etc.).

Frozen food product dispensing station includes three spigots 725, 730, and 735 for dispensing frozen food product. In some embodiments, more or fewer (as few as a single spigot) are provided for dispensing frozen food product. For example, frozen food product dispensing machine may include three freezer barrels and six spigots for providing six different types of frozen food product (e.g., vanilla, chocolate, strawberry, vanilla-chocolate swirl, vanilla-strawberry swirl, and chocolate-strawberry swirl). Processing electronics 632 may control a valve, spigot, or other appropriate actuator to cause frozen food product dispensing station 615 to dispense the desired frozen food product. The amount of frozen food product dispensed can be detected based on the amount of time the product is being dispensed (e.g., time during which the valve is open), detected by a flow sensor, detected based on the weight of the dispensed food product (e.g., by weight sensor 720), or various combinations thereof.

Referring to FIGS. 8-12, second movable platform 620 is configured to receive the dispensed container containing the dispensed frozen food product from first movable platform 610, move the dispensed container containing the dispensed frozen food product as necessary to receive the selected type and amount of one or more toppings from topping dispensing station 625, and move the dispensed container containing the dispensed frozen food product and toppings to a position to be transferred to user access station 630.

In some embodiments, second movable platform 620 is similar to first movable platform 610 described above. A second gantry 740 is used to move second movable platform 620. Second movable platform 620 includes a base 745, an arm 750 and a support platform 755. Support platform 755 includes a floor 760 for supporting the bottom of dispensed container 695 and a grip portion 765. Grip portion 765 defines a wall that extends upward from floor 760 and is curved in order to position and secure dispensed container 695. The wall includes an opening or cut-out 770 sized to receive arm 680 of first movable platform 610 and a second opening or cut-out 775 sized to receive a pusher arm 780 for transferring dispensed container 695 from second movable platform 620 (described in more detail below). Second movable platform 620 may also include a presence sensor 785 to detect the presence of dispensed container 695 on second movable platform 620. In some embodiments, presence sensor 785 is a photoelectric sensor (a photo eye), an infrared sensor, an inductive sensor, a laser sensor, a limit switch, a weight sensor (e.g., similar to weight sensor 720), or other sensor suitable for detecting the presence of a container. The wall of grip portion 765 may include an opening or cut-out 787 to provide a line-of-sight between presence sensor 785 and a container supported by support platform 755.

Figure 14:
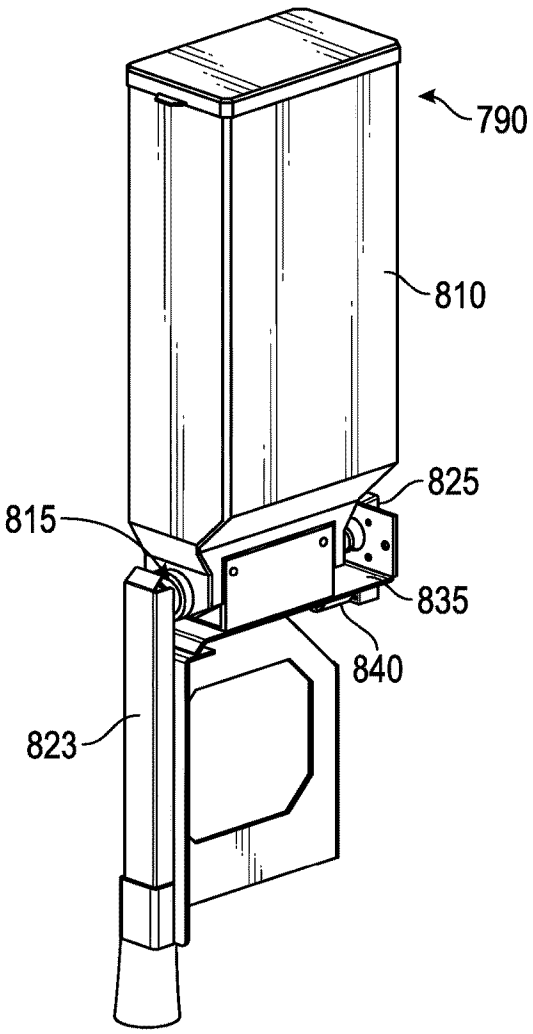
FIG. 14 is a perspective view of a topping dispenser of the topping dispensing station of FIG. 14.
Figure 13:
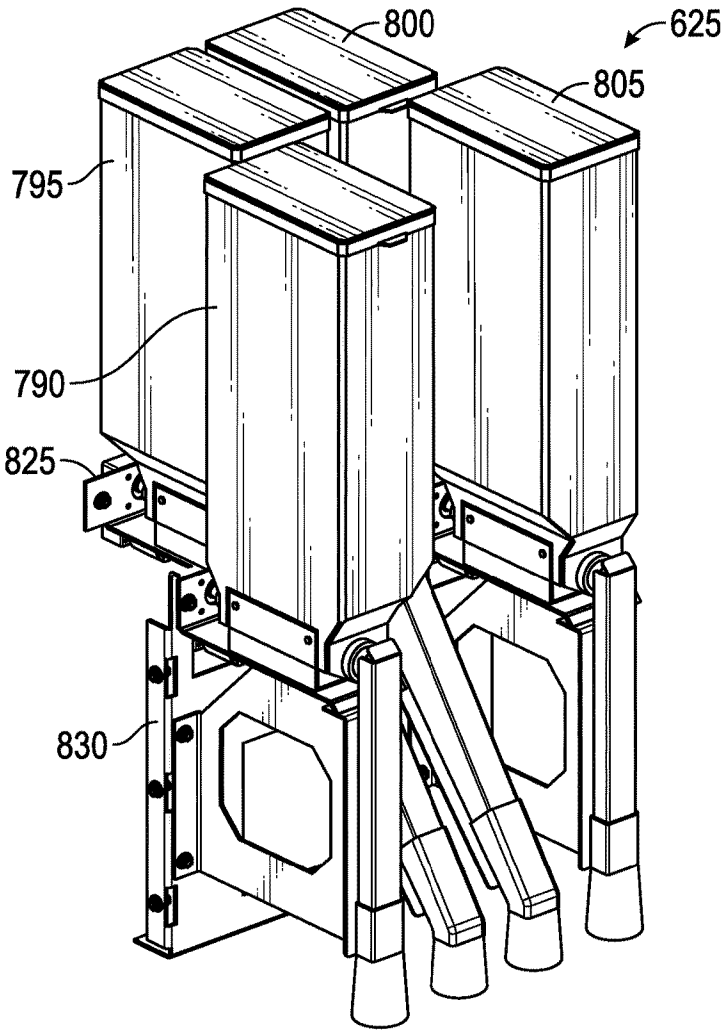
FIG. 13 is a perspective view of a topping dispensing station of the vending machine of FIG. 1.
Figure 15:
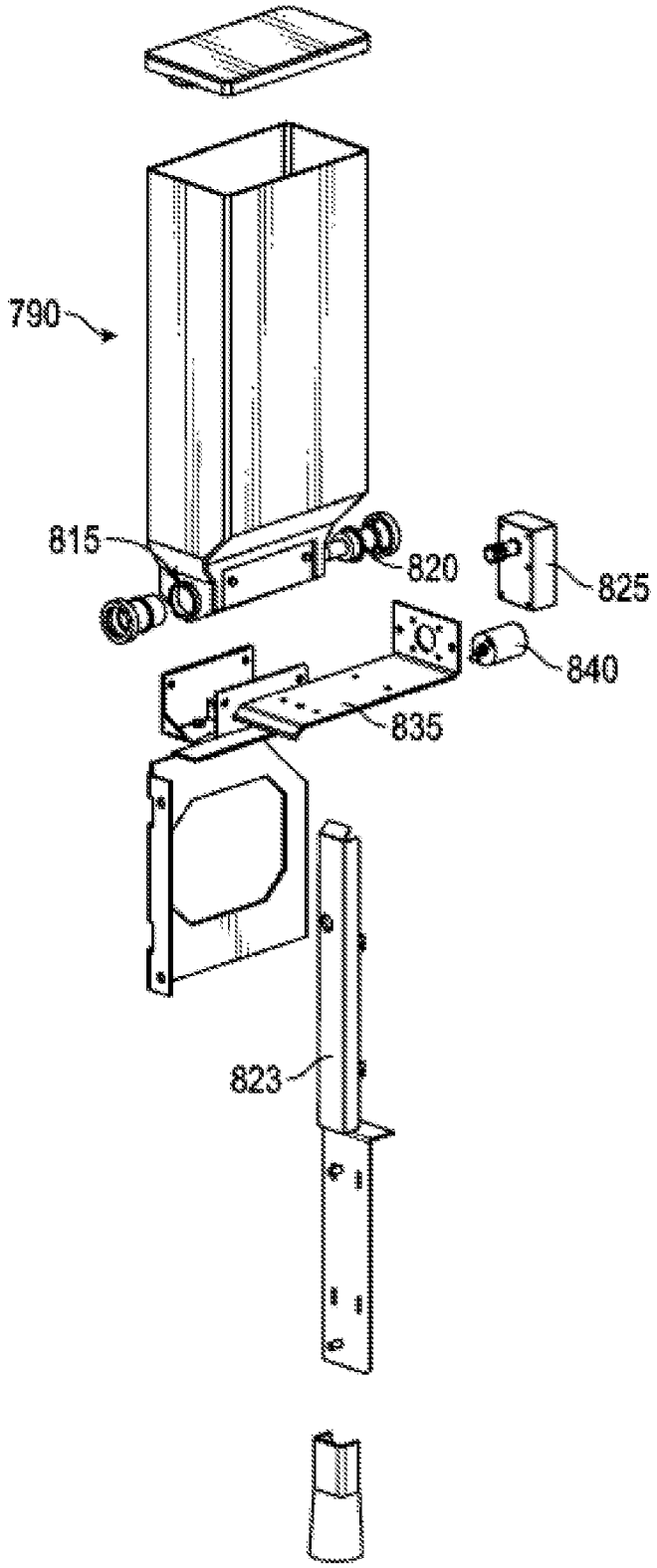
FIG. 15 is an exploded view of the topping dispenser of FIG. 14.

Referring to FIGS. 13-15, topping dispensing station 625 is configured to automatically dispense at least one topping. Toppings may be solid or liquid and may require refrigeration or not. For example, toppings can include various types of candy, sprinkles, fruit, syrups and other toppings appropriate for serving with a frozen food product.

Topping dispensing station 625 includes one or more topping dispensers suitable for dispensing solid toppings. As illustrated, topping dispensing station 625 includes four solid topping dispensers 790, 795, 800, 805. With reference to topping dispenser 790 as shown in FIGS. 14-15, each topping dispenser includes a container 810 for storing a solid topping, a dispense opening 815 through which the topping is dispensed, and an auger 820 for moving the topping from container 810 through dispense opening 815. A guide chute 823 directs the dispensed topping to the dispense position below the topping dispenser. A motor 825 drives auger 820 to dispense the topping. In some embodiments, motor 825 is a stepper motor. Each topping dispenser also includes a base 830 and an arm 835 extending from base 830. Arm 835 supports container 810. Each topping dispenser may also include a weight sensor 840. Weight sensor 840 may be used to monitor the amount of topping dispensed from container 810. In some embodiments, weight sensor 840 includes a strain gauge. As the topping is dispensed, the change in weight of the topping in container 810 causes arm 835 to move relative to base 830 and deforms the strain gauge. The deformation of the strain gauge provides an input which can be used by processing electronics 632 to determine the weight (amount) of topping dispensed from the topping dispenser. Processing electronics 632 may be configured to activate the motor to cause the topping dispenser to dispense topping. Processing electronics 632 may be configured to track the amount (weight) of topping stored in each container 810 to determine if a particular topping is available.

In some embodiments, topping dispensing station 625 is configured to dispense one or more liquid toppings (e.g., chocolate sauce, hot fudge, caramel, butterscotch, etc.) in place of or in addition to solid toppings. Topping dispensers for liquid toppings are known in the art and typically include a vertically movable pump lever that is depressed to dispense the liquid topping. A linear actuator, stepper motor or other appropriate automatic actuator may be used to depress the pump lever or actuate a pump to automate the operation of a liquid topping dispenser. Processing electronics may be configured to determine the amount of liquid topping dispenses based on an input from a flow sensor, an input from a weight sensor (e.g., similar to weight sensor 840), the duration of time the pump is activated, the number of steps of a stepper motor used to activate a pump, etc. In embodiments including one or more toppings that need to be refrigerated, a refrigeration enclosure and a related refrigeration system are included in order to maintain the toppings at the appropriate refrigerated temperature.

Figure 16:
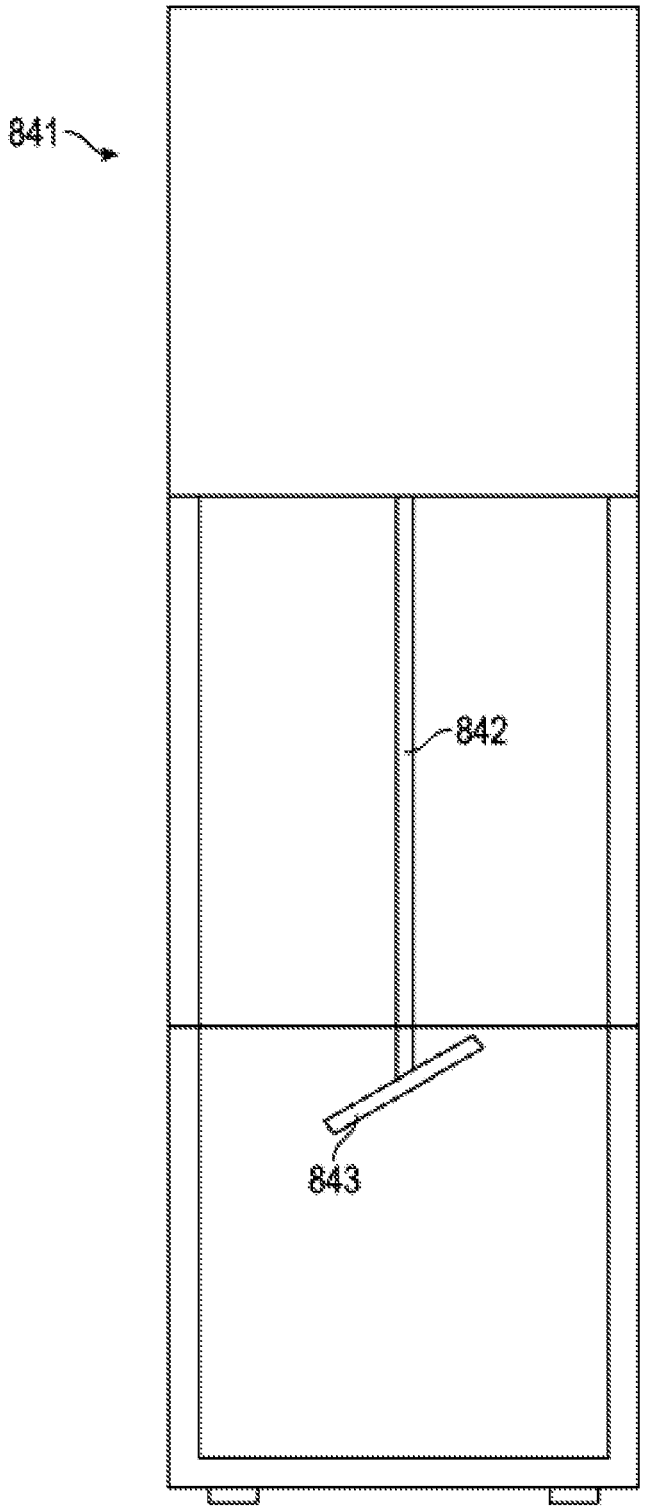
FIG. 16 is a front view of a mix-in blender.
Figure 17:
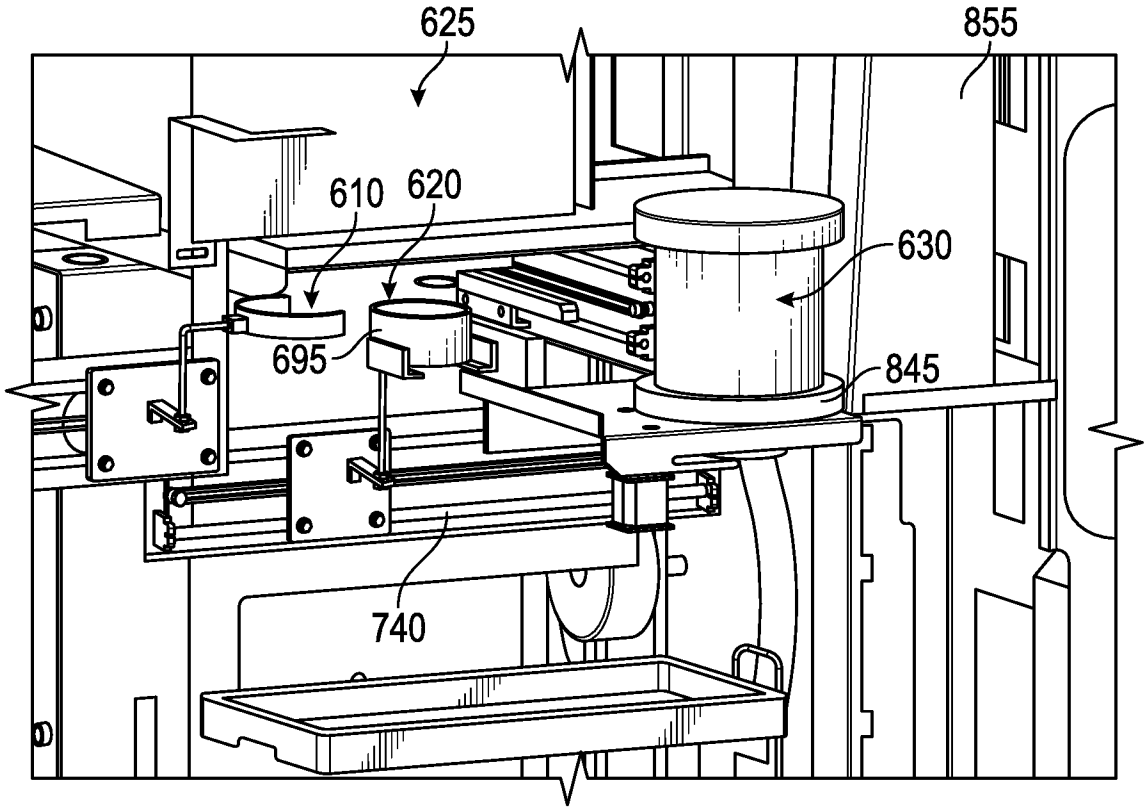
FIG. 17 is a perspective view of a portion of the vending machine of FIG. 1.
Figure 18:
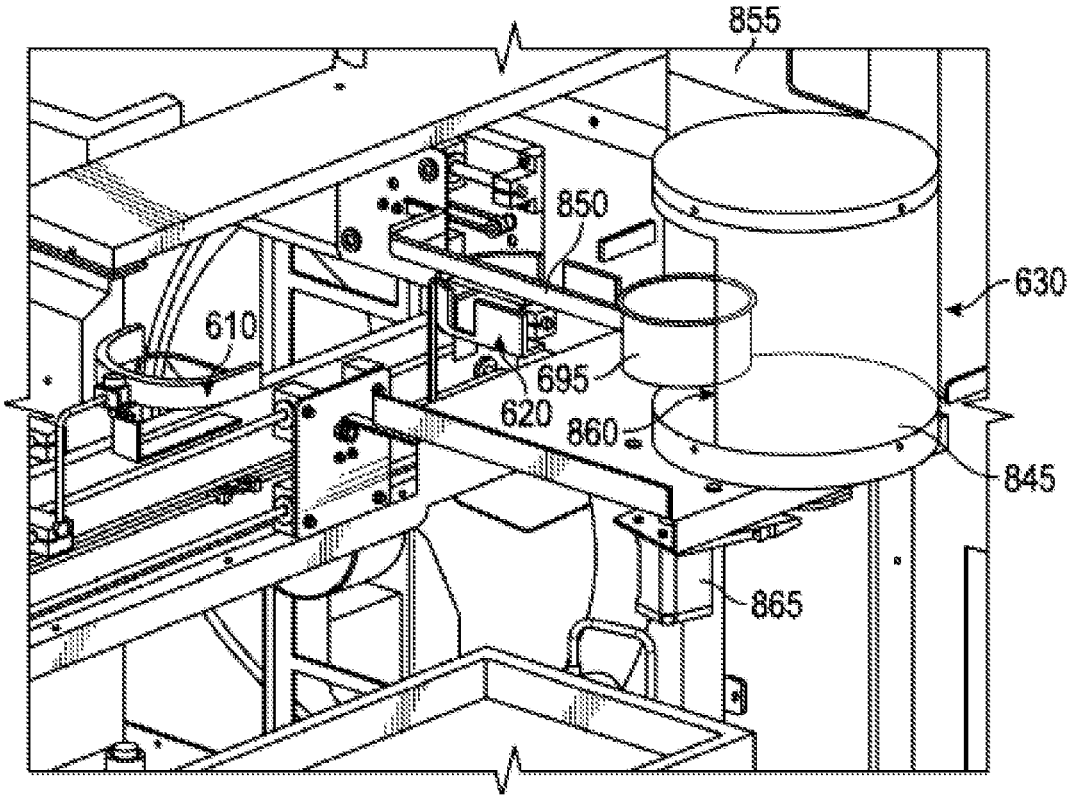
FIG. 18 is a perspective view of a portion of the vending machine of FIG. 1.
Figure 19:
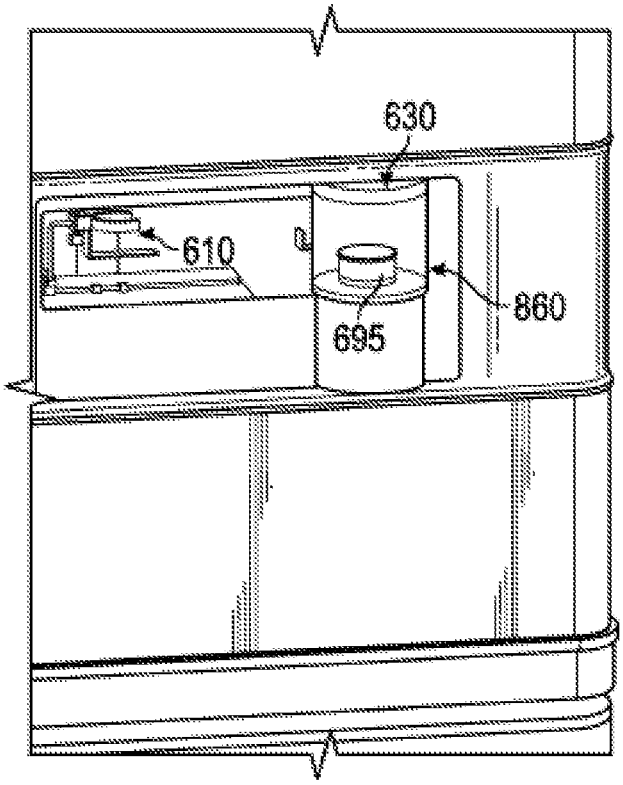
FIG. 19 is a perspective view of a portion of the vending machine of FIG. 1.
Figure 20:
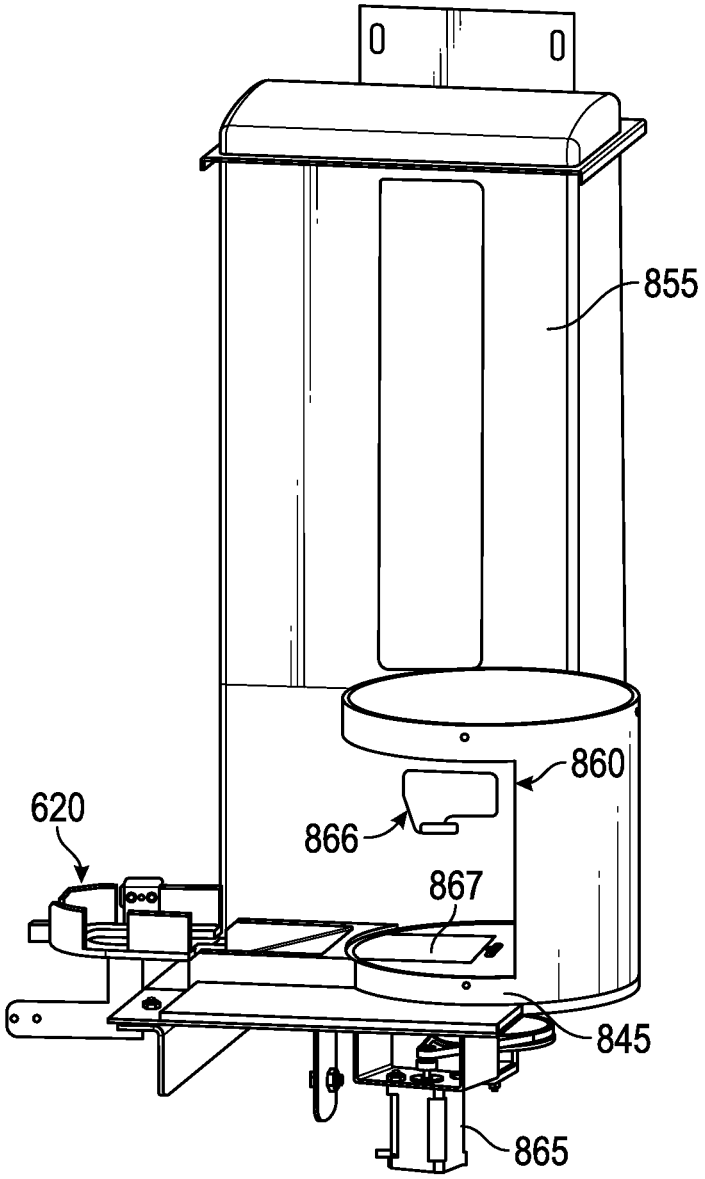
FIG. 20 is a perspective view of a portion of the vending machine of FIG. 1.

Referring to FIG. 16, in some embodiments, topping dispensing station 625 also includes a mix-in blender 841 to blend the dispensed toppings into the dispensed frozen food product. Mix-in blender 841 includes a spindle 842 and blades 843. Spindle 842 and blades 843 rotate to mix or stir a food product. In some embodiments, second movable platform 620 moves dispensed container 695 into a mixing position in which blades 843 are inserted into the dispensed frozen food product and toppings. Mix-in blender 841 is then activated by processing electronics 632 to mix the toppings into the frozen food product. Mix-in blender 841 is then deactivated and second movable platform 620 moves into a disengaged position in which second movable platform 620 and dispensed container 695 are clear to move without contacting mix-in blender. Alternatively, mix-in blender 841 includes a spindle 842 configured to move down and up between an inserted position and a removed position so that blades 843 are moved into and out of the dispensed food product and toppings rather than moving second movable platform 620. A linear actuator, motor (e.g., a stepper motor) is activated by processing electronics 632 to move spindle 842 as needed.

Referring to FIGS. 17-20, user access station 630 is configured to provide a user with access to a dispensed container that has been filled with the selected frozen food product and toppings.

User access station 630 includes a user access platform 845, a pusher arm 850, a utensil dispenser 855, and a user access door 860. User access platform 845 is rotatable and driven by a motor 865 (e.g., a stepper motor) between a transfer position in which dispensed container 695 may be transferred to user access platform 845 and a user access position in which a user may remove dispensed container 695 from user access platform 845 via user access door 860. Pusher arm 850 moves between a retracted position and an extended position to push dispensed container 695 from the second movable platform 620 onto user access platform 845. A linear actuator, motor (e.g., a stepper motor), or other appropriate actuator is used to move pusher arm 850. Utensil dispenser 855 is configured to store and dispense utensils, for example spoon, straws, or other utensils appropriate for consuming a frozen food product. Utensil dispenser 855 is configured to automatically dispense a single utensil at a time to dispense opening 866. Utensil dispenser 855 may be driven by a motor, for example a stepper motor. User access station 630 may also include a presence sensor 867 coupled to user access platform 845 to detect the presence of dispensed container 695. In some embodiments, presence sensor 867 is a weight sensor (e.g., a weight sensor including strain gauge similar to those described above). Processing electronics 632 may be configured to activate utensil dispenser 855 to dispense a single utensil after dispensed container 695 is detected by presence sensor 867. Processing electronics 632 may be configured to rotate user access platform 845 to the user access position after the utensil has been dispensed. After the user access platform 845 has finished moving, a user may reach through user access door 860 to remove dispensed container 695 including the selected frozen food product and toppings and the utensil. An additional presence sensor (e.g., photoelectric sensor, laser sensor, or other appropriate sensor) may be included to detect an unwanted object (e.g., a user's hand or arm, a stuck container, etc.) in the user access door or near the user access platform. Processing electronics 632 may be configured to use an input from the additional presence sensor to stop movement of one or more components of vending machine 600. Alternatively, additional presence sensor may be a hardwired interlock, rather than implemented by programming or computer code, to prevent movement of one or more of the components of vending machine 600.

Referring to FIGS. 1-2, vending machine 600 also includes a user input device 870 which allows user to select various aspects of the frozen food product and toppings to be dispensed. User input device 870 (e.g., a touch screen, a keypad, multiple pushbuttons or switches, etc.) allows a user to make various inputs or selections related to the frozen food product, topping, and container to be dispensed by vending machine 600 and provide these inputs to processing electronics 632. A payment device 875 receives the user's form of payment (e.g., paper money, coins, magnetized credit or debit cards, tokens, tickets, coupons, etc.) for the product to be prepared by vending machine 600. User may select frozen food product to be dispensed (e.g., flavor or type of frozen food product), one or more toppings to be included, and the amount of the desired frozen food product. In other embodiments the size and or type of the container may also be selected by the user. In the illustrated embodiment, user input device 870 is a touchscreen. A display (e.g., the touchscreen) is also provided to present selection options to the user. Processing electronics 632 may be configured to present information related to the types of frozen food product, toppings, and containers available to the user. Processing electronics 632 may be configured to provide information to user indicating if a type of frozen food product, topping, or container is sold out or not available for purchase.

Vending machine 600 also includes a housing 880 having a base 885 and two access doors 890 and 895. The two access doors 890 and 895 are movable relative to base 885 to provide access to the various internal components of vending machine 600. The various panels that make up housing 880, including base 885 and access doors 890 and 895, do not include any externally visible fasteners. All fasteners can be secured internally through the open access doors and any necessary access panels. Not including any externally visible fasteners helps to make vending machine 600 difficult to tamper with or breach, for example in an attempt to steal money from payment device 875.

In some embodiments, user input device 870 and payment device 870 are located remotely from housing 880. For example, in a restaurant or food service station, user input device and payment device could be a cash register operated by an employee. The cash register could communicate with an automated vending machine to make the desired product. This could reduce the number of active employees needed by possibly eliminating an employee previously needed to make the desired product. This could also reduce waste by eliminating human error in the amount of frozen food product and toppings dispensed for a given product because the amounts dispensed are monitored by the automated vending machine.

Vending machine 600 also includes a controller or processing electronics 632. Processing electronics 632 control the operation of the vending machine 600 as described herein. Processing electronics 632 includes a processor 900 and memory 905. In some embodiments, processing electronics 632 may include features of processing electronics 240 described above.

Figure 21:
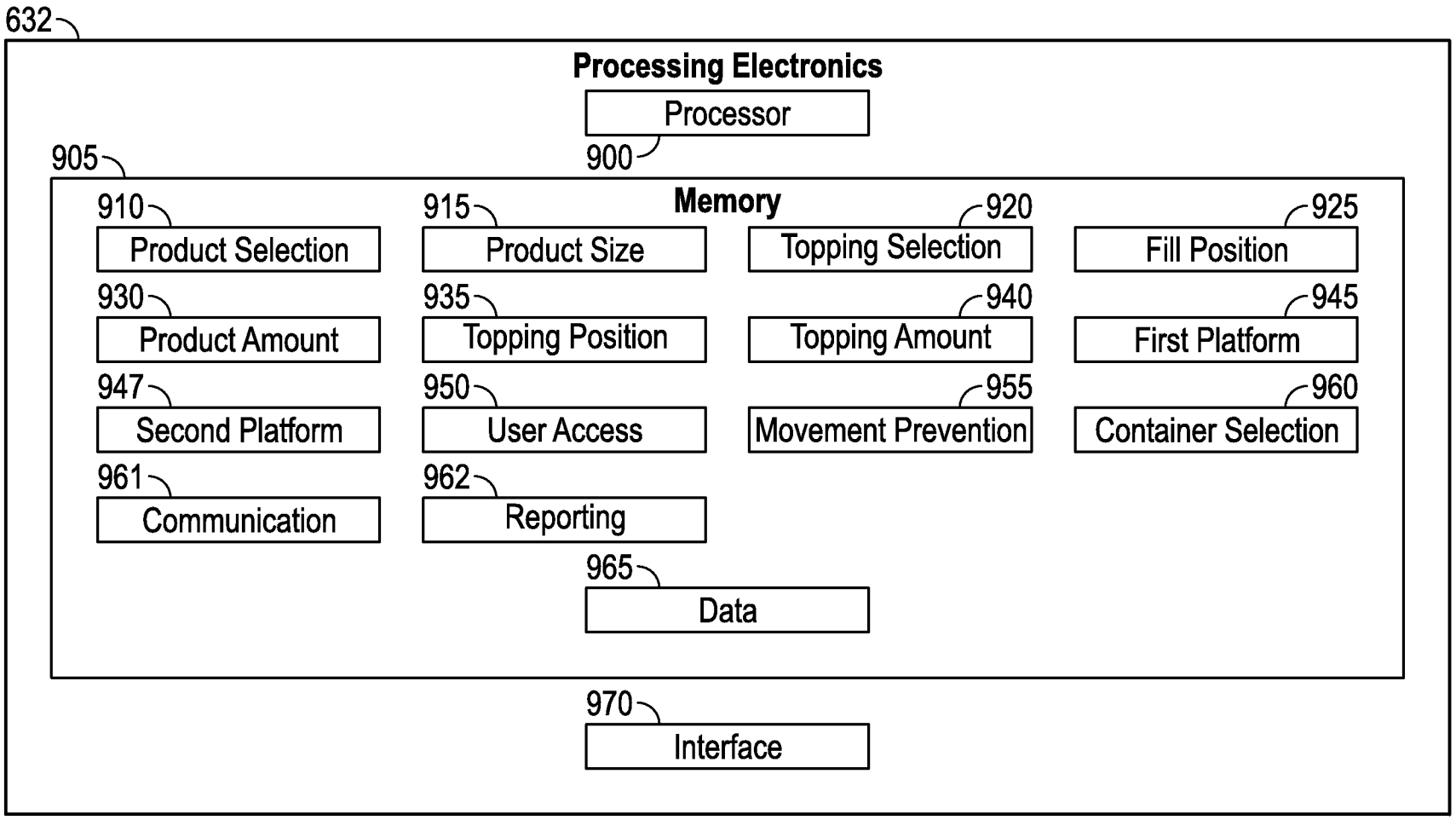
FIG. 21 is a block diagram of processing electronics configured to control the vending machine of FIG. 1.

Referring to FIG. 21, a block diagram of the processing electronics or circuit is shown, according to an exemplary embodiment. Processor 900 may be or include one or more microprocessors (e.g., CPUs, GPUs, etc.), an application specific integrated circuit (ASIC), a circuit containing one or more processing components, a group of distributed processing components (e.g., processing components in communication via a data network or bus), circuitry for supporting a microprocessor, or other hardware configured for processing data. Processor 900 is also configured to execute computer code stored in memory to complete and facilitate the activities described herein. Memory 905 can be any volatile or non-volatile computer-readable storage medium, or combinations of storage media, capable of storing data or computer code relating to the activities described herein. For example, memory 905 is shown to include computer code modules such as a frozen food product selection module 910, a frozen food product size selection module 915, a topping selection module 920, a fill position determination module 925, a product amount determination module 930, a topping position determination module 935, a topping amount determination module 940, a first movable platform position module 945, a second movable platform position module 947, a user access station module 950, a movement prevention module 955, a container selection module 960, a communication module 961, and a reporting module 962. In some embodiments, more or fewer modules are included. Memory 905 may also include various types of data 965 including desired product data, position, presence, and quantity data, etc. to be used in determinations made by processing electronics 632. When executed by processor 900, processing electronics 632 is configured to complete the activities described herein.

Processing electronics 632 also includes a hardware interface 970 configured to receive data (e.g., electrical signals)

as input(s) to processing electronics 632 and provide data (e.g., electrical signals) as output(s) from processing electronics 632. Hardware interface 970 may be configured to receive data as input(s) to processing electronics 632 (e.g. from user input device 870, payment device 875, various sensors, motors, and actuators described above and/or communicate data as output(s) to another computing device or other components of the vending machine (e.g., user interface device, display, motors, linear actuators, etc. to implement the operation of the vending machine as described herein). Hardware interface 970 may include circuitry to communicate data via any number of types of networks or other data communication channels. For example, hardware interface 970 may include circuitry to receive and transmit data via a wireless network or via a wired connection. In another example, hardware interface 970 may include circuitry configured to receive or transmit data via a communications bus with other electronic devices. Hardware interface 970 may include an antenna, data port, or other appropriate connection for connecting processing electronics 632 to other components of vending machine or external devices.

Memory 905 may include frozen food product selection module 910. Product selection module 910 may be configured to identify the frozen food product selected by a user via user input device 870. Such a selection can be made based on the flavor of the desired frozen product dispensed by the spigots (e.g., vanilla, chocolate, and twist) or based on the location of the spigot (e.g., left, right, and center) that dispenses the desired flavor of frozen food product. Product selection module 910 may be further configured to determine if sufficient funds have been deposited via payment device 875 to pay for the selected frozen food product.

Memory 905 may include frozen food product size selection module 915. Product size selection module 915 may be configured to identify the amount (e.g., volume) of selected frozen food product to be dispensed as selected by a user via user input device 870. Such a selection may be based on a relative size (e.g., small, medium, large, extra-large, etc.), based on a volumetric measurement, based on a weight, etc. Product size selection module 915 may be further configured to determine if sufficient funds have been deposited via payment device 875 to pay for the selected amount frozen food product.

Memory 905 may include topping selection module 920. Topping selection module 920 may be configured to identify one or more toppings selected by a user via user input device 870. Such a selection can be made based on the type or flavor of the desired toppings dispensed by the topping dispenser (e.g., sprinkles, chocolate chips, various types of candy pieces, various types of nuts, various types of liquid sauces, various types of fruit toppings, etc.) or based on the location of the topping dispenser (e.g., first, second, third, fourth, etc. from left-to-right) that dispenses the desired topping. Topping selection module 920 may also be configured to identify an amount of the selected topping to be dispensed. Such an identification may be based on a relative size (e.g., small, medium, large, extra-large, etc.), based on a volumetric measurement, based on a weight, etc. Topping selection module 920 may be further configured to determine if sufficient funds have been deposited via payment device 875 to pay for the selected topping(s).

Memory 905 may include fill position determination module 925. Fill position determination module 925 may be configured to determine to which of the fill positions (i.e., one under each spigot 725, 730, and 735) first movable platform 610 will move to in order to receive the selected frozen food product. This determination may be made in response to inputs from the product selection module 910 and product size selection module 915.

Memory 905 may include product amount determination module 930. Product amount determination module 930 may be configured to determine how much of the selected frozen product will be dispensed and/or how much of the selected frozen food product has been dispensed. The amount to be dispensed may be determined in response to inputs from the product size selection module 915. The amount that has been dispensed may be determined by the amount of time the dispensing spigot or valve has been opened, an input indicative of the change in weight detected by the weight sensor of first movable platform 610, a combination of the two, or other appropriate method (e.g., an input from a flow sensor).

Memory 905 may include topping position determination module 935. Topping position determination module 935 may be configured to determine which of the topping dispenser positions (i.e., one under each topping dispenser 790, 795, 800, 805), second movable platform 620 will move to receive the selected topping(s). This determination may be made in response to inputs from the topping selection module 920.

Memory 905 may include topping amount determination module 940. Topping amount determination module 940 may be configured to determine how much of the selected topping will be dispensed and/or how much of the selected topping has been dispensed. The amount to be dispensed may be determined in response to inputs from the topping selection module 920. The amount to be dispensed may vary based on the selected amount of frozen food product and/or the size of the selected container. The amount that has been dispensed may be determined by the amount of time the selected topping dispenser is operated (e.g., the amount of time the motor is driving the dispensing auger), an input indicative of the change in weight detected by the weight sensor of the topping dispenser, an input indicative of the change in weight detected by a weight sensor of the second movable platform, or combinations thereof.

Memory 905 may include first movable platform position module 945. First movable platform position module 945 is configured to determine and track the position of first movable platform 610 across the range of motion of first movable platform 610 (e.g., based on position of linear actuators, based on step count of stepper motor or motors used to move first movable platform 610, based on operating time of linear actuators, based on operating time of stepper motors or motors, etc.). First movable platform position module 945 may identify various intended positions of first movable platform 610 (e.g., container dispense position, selected frozen food product dispense position, transfer position with second movable platform 620, etc.) relative to a home position or relative to one another. For example, first movable platform position module 945 may include data indicating the number of steps needed by the first stepper motor and the second stepper motor of the first gantry 665 and/or the amount of operating time need by the first stepper motor and the second stepper motor of the first gantry 665 to move first movable platform 610 from the container dispense position under container dispenser 605 to the frozen food product dispense position under first spigot 725. First movable platform position module 945 may also be configured to provide outputs to first movable platform 610 to cause the first movable platform to move (e.g., to activate linear actuators or stepper motors).

Memory 905 may include second movable platform position module 947. Second movable platform position module 947 is configured to determine and track the position of second movable platform 620 across the range of motion of second movable platform 620 (e.g., based on position of linear actuators, based on step count of stepper motor or motors used to move second movable platform 620, based on operating time of linear actuators, based on operating time of stepper motors or motors, etc.). Second movable platform position module 947 may identify various intended positions of second movable platform 620 (e.g., transfer position with respect to first movable platform 610, selected topping dispense position, transfer position with respect to user access station 630, etc.) relative to a home position or relative to one another. For example, second movable platform position module 947 may include data indicating the number of steps needed by the first stepper motor and the second stepper motor of the second gantry 740 and/or the amount of operating time need by the first stepper motor and the second stepper motor of the second gantry 740 to move second movable platform 620 from the transfer position with respect to first movable platform 610 to the topping dispense position under the first topping dispenser 790. Second movable platform position module 947 may also be configured to provide outputs to second movable platform 620 to cause second movable platform 620 to move (e.g., to activate linear actuators or stepper motors).

Memory 905 may include user access station module 950. User access station module 950 may be configured to actuate pusher arm 850 to transfer a container from second movable platform 620 to user access platform 845. User access station module 950 may be configured to detect the presence of a container on user access platform 845 via an input from a weight sensor or a presence sensor (e.g., sensor 867). User access station module 950 may be configured to provide an output to utensil dispenser 855 to dispense a utensil in response to detecting a container on the user access platform 845. User access station module 950 may be configured to provide an output to rotate user access platform 845.

Memory 905 may include movement prevention module 955. Movement prevention module 955 may be configured to prevent movement of user access platform, utensil dispenser, pusher arm, second movable platform, topping dispensing station, first movable platform, dispensing station, container dispenser and other automated moving components of the vending machine when an unwanted object is detected in the user access door, near the user access platform, or when one of the housing doors is opened. A presence sensor (e.g., photoelectric sensor, laser sensor, or other appropriate sensor) may be used to provide an input to movement prevention module 955 of an unwanted object (e.g., a user's hand or arm, a stuck container, etc.) in the user access door or near the user access platform. A limit switch, magnetic switch, or other appropriate switch may be used to provide an input to movement prevention module that one of the housing access doors has been opened. Alternatively or additionally, movement prevention module 955 may be a hard-wired interlock, rather than a computer code module, configured to prevent movement of one or more of the automated moving components of the vending machine.

Memory 905 may include container selection module 960. Container selection module 960 may be configured to identify the frozen food product container selected by a user via user input device 870. Such a selection can be made based on the type of the desired container (cone, cup, bowl, etc.) or based on the location of the desired container sleeve that dispenses the desired container. Selections may also include the size of the desired container based on a relative size (e.g., small, medium, large, extra-large, etc.), based on a volumetric measurement, etc. Container selection module 960 may be further configured to determine if sufficient funds have been deposited via payment device 875 to pay for the selected container and size of container.

Memory 905 may also include a communication module 961. Communication module 961 may be configured to provide for communication between systems and devices both internal and external to vending machine 600. For example, the communication module may be configured to use an antenna or data port for communication over a network. For example, the communication module may be used to communicate data related to vending machine 600 over a wireless network (e.g., Wi-Fi or cellular) or over the internet.

Memory 905 may also include a reporting module 962. Reporting module 962 may be configured to gather or compile various data related to the status, performance, operation, sales, etc. of vending machine and package that data into a report. Reporting module 962 may be configured to provide communication module 961 with the necessary inputs to transfer a report over a wireless network or the internet to a user (e.g., the owner of vending machine, the person or company responsible for stocking vending machine, etc.).

Reporting module 962 may gather or compile vending machine information. Vending machine information may include a store number or unique identifier used to identify a particular vending machine, location information about the specific location of a particular vending machine including location type, location address, and location description, region information about the specific region a particular vending machine is located in (e.g., a particular sales region, a particular state or other geographic region, etc.), franchisee/licensee information about a particular franchisee or licensee using or responsible for a particular vending machine, and product information including number of types of frozen food product, toppings, and containers that can be dispensed by a particular vending machine.

Reporting module 962 may gather or compile sales information. Sales information may include quantity or currency value of sales by type of frozen food product, flavor of frozen food product, size of frozen food product, type of topping, flavor of topping, size of topping, type of payment (e.g., cash, debit, credit, vouchers etc.). Sales information may be presented as gross or net sales. Sales information may also include quantity or currency value of discounts and refunds. Sales information may also include cancellation information including quantity of cancellations and location of the cancellation during the ordering process. Sales information may also include invoice information, including quantity of invoices and average invoices.

Reporting module 962 may gather or compile usage information. Usage information may include quantity (e.g., servings, volume, etc.) of type of frozen food product dispensed, flavor of frozen food product dispensed, type of container dispensed, size of container dispensed, type of topping dispensed, flavor of topping dispensed. Usage information may also include quantity (e.g., servings, volume, etc.) of type of frozen food product available, flavor of frozen food product available, type of container available, size of container available, type of topping available, flavor of topping available. Reporting module 962 may gather or compile operation information. Operation information may include time a particular vending machine is in use (awake), not in use (asleep or standby), or out of service (e.g., out of stock, not operational due to an error or damage, etc.), number and frequency of service calls and dates of such service calls (e.g., to stock vending machine, to repair vending machine, etc.), current status of a particular vending machine (e.g., awake, asleep, out of service, etc.), and error information including type of error, time and date error occurred, time and date error was resolved, etc.

Reporting module 962 may generate reports including relevant information (e.g., vending machine information, sales information, usage information, etc.). Reports may include reports for a single machine and reports for a group of machines (e.g., from a particular location, from a particular type of location, from a particular region, for a particular franchisee or licensee, etc.). Reports may provide relevant information for a particular date range. The date range may be customizable and specified by a user, or may be set for a particular time period (e.g., daily, weekly, monthly, quarterly, yearly, etc.). Reports may present aggregate or to-date data or may present trends across particular time periods (e.g., daily, weekly, monthly, quarterly, yearly, etc.).

Reporting module 962 may also be configured to monitor the status of vending machine 600. Monitoring may include detecting errors in operation of vending machine, detecting out-of-stock errors in vending machine, etc. Reporting module 962 may detect errors in the operation of vending 600 by comparing expected operation versus actual operation of the various components of vending machine 600. For example, if frozen food product dispensing station 615 indicates that frozen food product is being dispensed, but weight sensor 720 of first movable platform 610 is not detecting a change in weight indicative of frozen food product reaching dispensed container 695, this may indicate that frozen food product dispensing station 615 is out of product, that first movable platform 610 has not reached the proper dispense position, or some other error in operation of vending machine 600. The various actuators and motors of vending machine 600 may also experience operational error states. For example, a motor drawing an unexpectedly large current may indicate a jam or other obstruction that is preventing the motor from moving a component as intended (e.g., first gantry 665 could be bound up or otherwise jammed, preventing motors from moving gantry 665 as intended). The various sensors of vending machine 600 may also indicate out-of-stock error states. For example, an out of containers error may be generated when container presence 653 indicates no containers present in any of container sleeves 650. Reporting module 962 may be configured to track operation time of each freezer barrel of frozen food product dispensing station 615 to determine when a freezer barrel is out of stock or to track total weight of frozen food product dispensed from each freezer barrel with weight sensor 720 to determine when a freezer barrel is out of stock. Reporting module 962 may be configured to detect when a topping dispenser is out of stock based on an input from the weight sensor associated a particular topping dispenser.

Reporting module 962 may be configured to provide error monitoring reports to indicate errors in real time, or batched error reports at particular times (e.g., morning, noon, end of business day, etc.). Such error reports can be routed to a service provider who is tasked with fixing operation errors and/or restocking vending machine 600. In this way, the service provider can tend to vending machine 600 on an as-needed basis.

Data 965 may include desired product data. In general, desired product data may include end user-provided data to indicate the desired product to be produced by the vending machine (e.g., a sundae). End user-provided data may include, but is not limited to, data regarding the desired frozen food product, the desired amount of frozen food product, the desired topping or toppings, the desired type of container selected by the user, and the desired container size selected by the user (e.g., via user input device 870), payment for the desired product as selected by the user (e.g., via payment device 875). Desired product data may also include vendor data indicating what products the vendor has stocked in the vending machine. Vendor data may include, but is not limited to, type(s) of frozen food product provided in the frozen food product dispensing station, which spigot provides which type of frozen food product, the type(s) of topping provided in the topping dispensing station, which topping dispenser provides which type of topping, the type(s) of utensil provided in the utensil dispenser, the size(s) and type(s) of container provided in the container dispenser, and which size and type of container is provided in which container storage location (e.g., container support sleeve).

Data 965 may include position, presence, and quantity data. Position data may track and store data related to the position of the various automated moving components of the vending machine. Presence data may track and store data related to the presence of a dispensed container in the vending machine (e.g., which platform(s) currently contain a dispensed container). Quantity data may track and store date related to the quantities of perishable goods stored in the vending machine (e.g., number of containers, amount of frozen food product, amount of toppings, number of utensils). In some embodiments, the various components storing perishable goods are sized to provide a common number of servings before needing to be refilled. For example, the maximum amount of containers, frozen food product, toppings, and utensils may enable vending machine 600 to produce a predetermined number of servings (e.g., 100, 150, 200, etc.) before vending machine 600 needs to be refilled.

In operation, processing electronics 632 may be configured or programmed to operate vending machine according to various embodiments of the methods of operation described herein.

Figure 22:
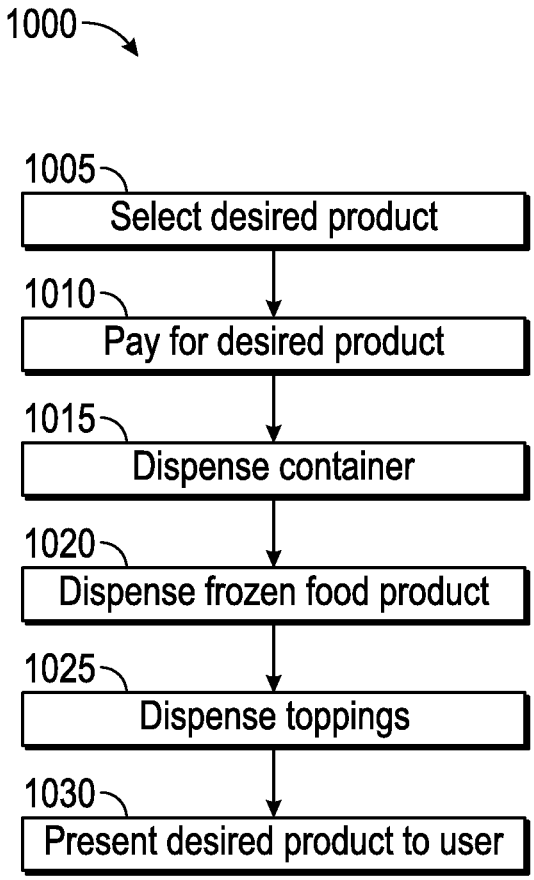
FIG. 22 is a flow chart of a method of operating an automatic frozen food product vending machine according to an exemplary embodiment.

Referring to FIG. 22, a method of operating an automated frozen food product vending machine 1000 is described according to an exemplary embodiment. A user selects (step 1005) and pays for a desired product (step 1010) (e.g., a sundae, a cone, a dish of frozen food product, a shake, a frozen beverage, etc.) (e.g., via user input device and payment device). The user may make the selections and then be informed of the necessary payment or can make the payment and then make the necessary selections in view of the amount of payment made. Desired product selections may include desired type and/or size of container, desired type of frozen food product, desired amount of frozen food product, desired toppings, and desired amount of toppings. After the user has made and/or confirmed the desired product selections, the vending machine automatically dispenses the selected frozen food product and toppings into the selected frozen food product container and presents the finished product with a utensil to the user without any further interaction with the user.

After the user's selection and payment have been entered, the selected container is dispensed (step 1015). In some embodiments, the first movable platform moves to a position below the container dispenser in which the arm of the first movable platform is aligned with the dispense opening of the container dispenser. The dispense mechanism automatically dispenses a single cup onto the arm of the first movable platform. As the first movable platform moves upward towards the container dispenser, a finger or post contacts the movable arm of the first movable platform moving the arm into the open position so that the first movable platform may receive the container to be dispensed. After the container has been dispensed onto the first movable platform, the movable platform moves downward bringing the finger out of contact with the movable arm and allowing the arm to move to the closed position, thereby securing the dispense container onto the first movable platform.

After the selected container has been dispensed, it is filled with the selected amount of the selected frozen food product (step 1020). In some embodiments, the movable platform moves to a selected dispense position to receive the frozen food product selected by the user. At this position the selected amount of frozen food product is dispensed. The amount of frozen food product dispensed can be monitored by the time of dispensing, the weight of dispensed frozen food product detected by the weight sensor of the first movable platform, a flow of dispensed frozen food product as detected by a flow sensor, or combinations thereof.

After the frozen food product has been dispensed, any selected toppings are added to the container (step 1025). In some embodiments, the second movable platform moves to a transfer position and the first movable platform, now supporting the container including the dispensed frozen food product, moves to a related transfer position where the container is able to be transferred from the first movable platform to the second movable platform. The arm of the first movable platform passes through the associated cut-out in the second movable platform so that the dispensed frozen food product container is aligned with the support base of the second movable platform. The first movable platform is then withdrawn with the wall of the second movable platform preventing the dispensed container from moving with the first movable platform, thereby transferring the dispensed frozen food product container to the second movable platform. The movable arm of the first frozen food product container contacts the container itself of a finger of post and is moved to the open position as the first movable platform moves away from the second movable platform. The second movable platform then moves to a position beneath the topping dispensing station. The position is associated with the selected topping or toppings to be dispensed. At each of the selected topping positions, the topping dispenser for the associated position dispenses the selected amount of topping. For example, the motor is used to actuate the auger thereby dispensing topping through the dispense opening of the topping dispenser with the topping falling into the container and/or onto the dispensed frozen food product. The amount of dispensed topping may be monitored by the weight sensor associated with the topping dispenser.

After receiving all of the selected toppings, the container including the dispensed frozen food product and toppings is presented to the user for consumption (step 1030). In some embodiments, the second movable platform moves to a position adjacent the user access platform. The pusher arm moves from the retracted position to the extended position, passing through the associated cut-out of the wall of the second movable platform, thereby moving the now-finished product to the user access platform. The pusher arm contacts the container to move the finished product from the second movable platform to the user access platform. The weight sensor of the user access platform determines the presence of the finished product and confirms that it has been successfully transferred by the pusher arm. The utensil dispenser dispenses a single utensil. The user access platform rotates to the user access position in which the user may access the completed product and utensil through the user access door. Before the user access platform is rotated to this user access position, the user cannot reach through the user access door into the interior of the vending machine.

Figure 23:
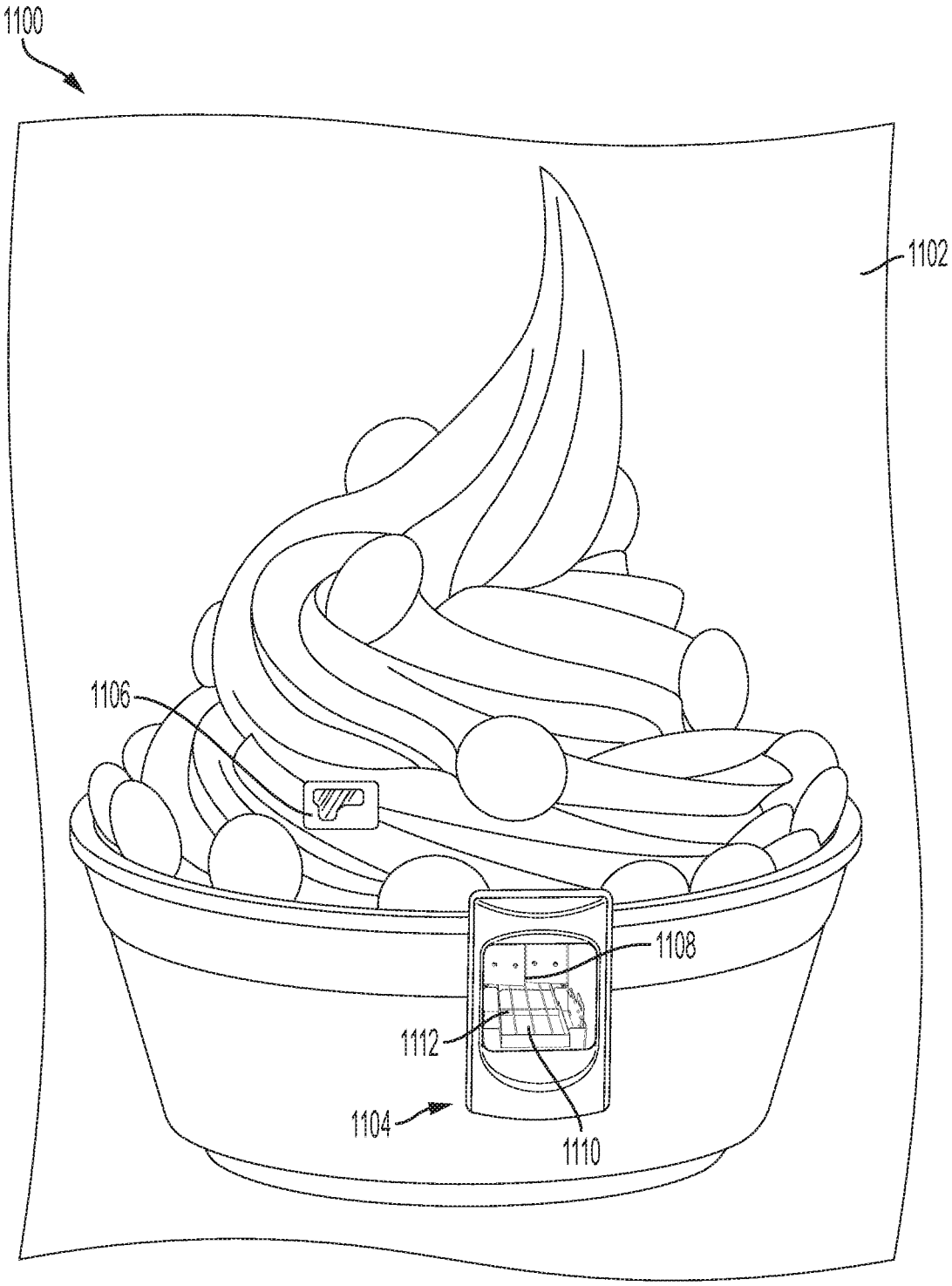
FIG. 23 is a perspective view of a portion of an automatic product vending machine with a delivery door according to an exemplary embodiment.

Referring now to FIGS. 23-34 an automated or automatic frozen food product vending machine 1100 is depicted, according to an exemplary embodiment. Vending machine 1100 is similar to vending machine 600 described above, with particular details of vending machine 1100 described below. Referring specifically to FIG. 23, vending machine 1100 is shown to include a housing 1102, a user access station 1104, and a utensil dispense opening 1106. In some embodiments, utensil dispense opening 1106 is identical or substantially similar to dispense opening 866 (described above with reference to FIG. 20), and may be coupled to a utensil dispenser (e.g., utensil dispenser 855). The user access station 1104 is shown to include, among other components, a user access door 1108, a user access platform 1110, and a user indicator light 1112. In contrast to the user access station 630 with rotatable user access platform 845 (described above with reference to FIG. 18) user access door 1108 is configured to slide in a vertical direction to permit a user to remove a container of frozen food product from vending machine 1100.

Figure 24:
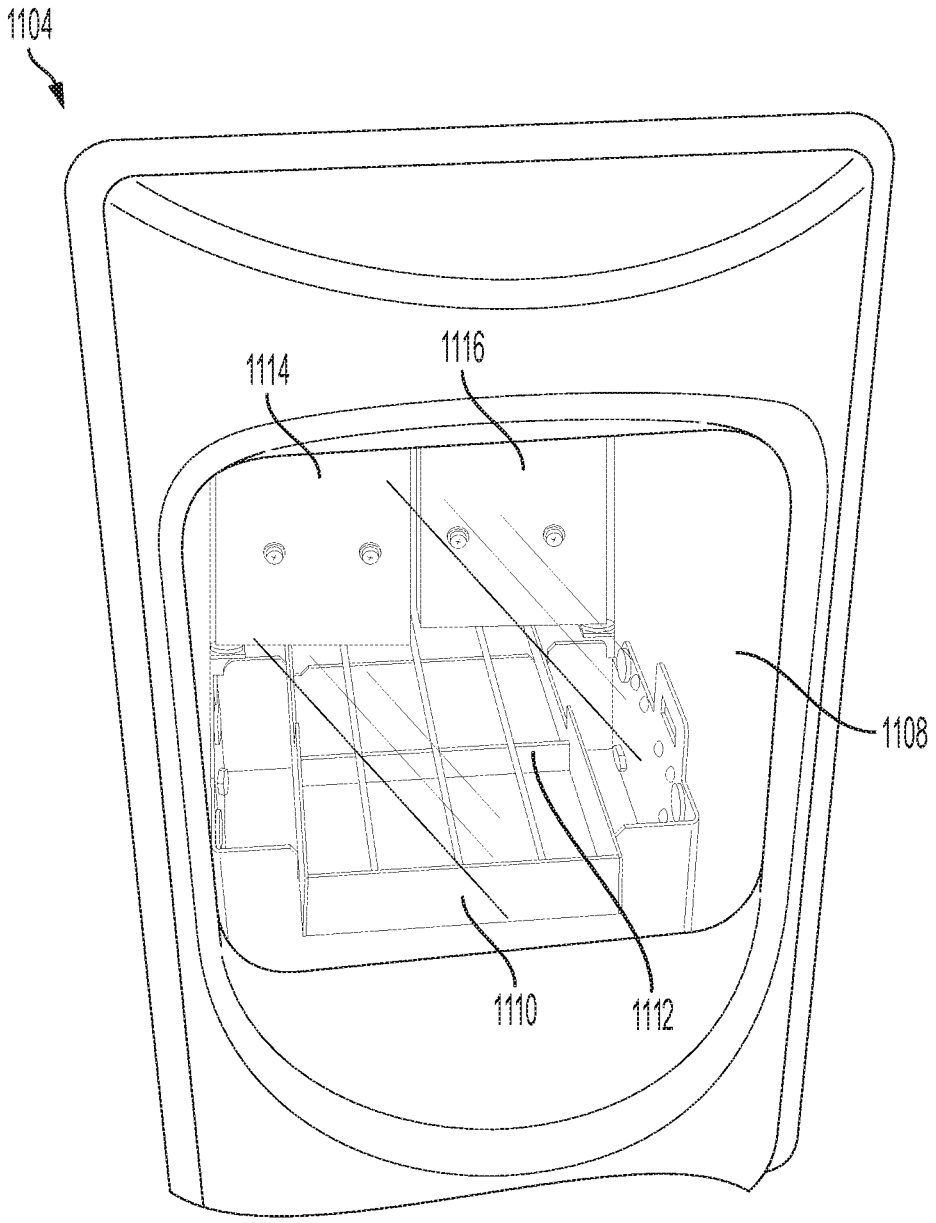
FIG. 24 is a perspective view of a user access platform portion of the vending machine of FIG. 23.

Referring specifically to FIG. 24, an additional view of the user access station 1104 prior to the dispensing of the frozen food product is shown, according to an exemplary embodiment. The user indicator light 1112 may be any suitable light or lights (e.g., one or more LEDs) configured to illuminate in a succession of different colors to indicate the progress of steps in the vending process. In some embodiments, certain colors may correspond to steps in the vending process not visible to the user. For example, the user indicator light 1112 may be illuminated pink to indicate that the frozen food product is currently being dispensed into a container (e.g., step 1020, described above with reference to FIG. 22), and the user indicator light 1112 may subsequently be illuminated green to indicate that toppings are currently being added to the container (e.g., step 1025).

Figure 25:
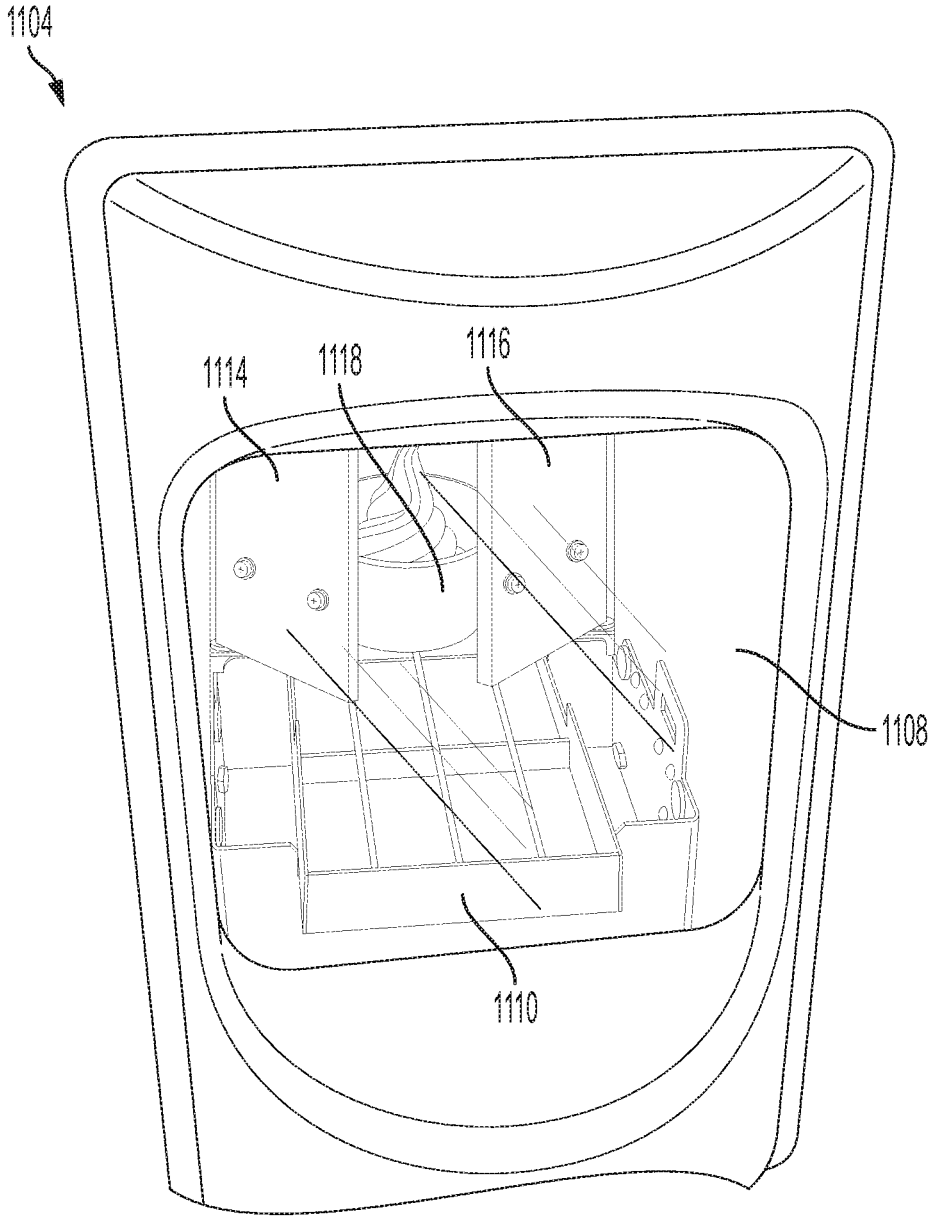
FIG. 25 is a perspective view of the user access platform portion of the vending machine of FIG. 23.
Figure 26:
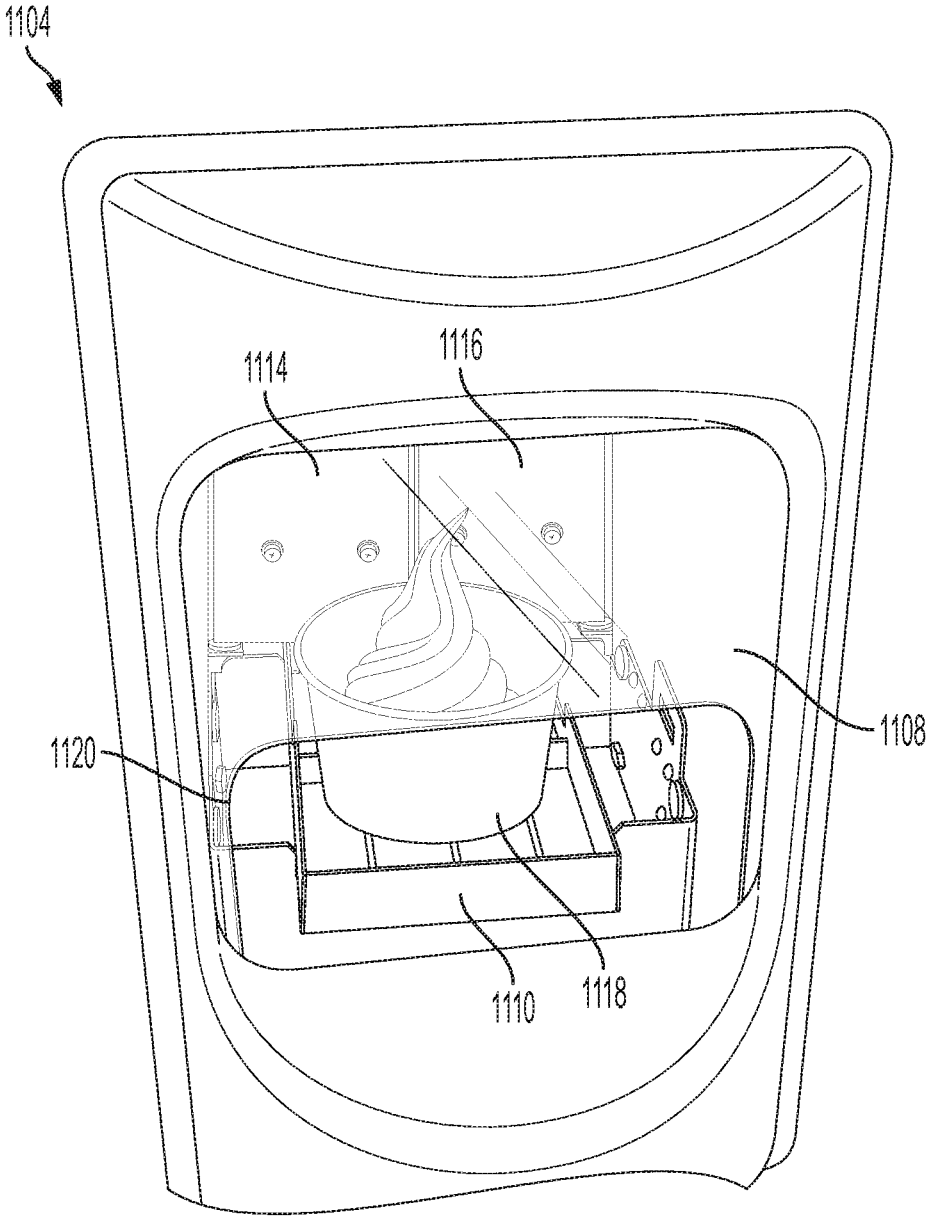
FIG. 26 is a perspective view of the user access platform portion of the vending machine of FIG. 23.

Turning now to FIGS. 25-26, views of the user access station 1104 during the process of dispensing a container 1118 of frozen food product are shown, according to an exemplary embodiment. Before the container 1118 is deposited on user access platform 1110, the user access door 1108 is positioned such that the user is blocked from reaching inside the user access station 1104. The container 1118 may enter the user access station 1104 via a first swinging door 1114 and a second swinging door 1116. The first swinging door 1114 and the second swinging door 1116 are biased to remain in a closed position until a pusher arm (e.g., pusher arm 850, described above with reference to FIG. 18) causes the swinging doors 1114 and 1116 to rotate outwards, permitting the pusher arm to deposit the container 1118 on the user access platform 1110. In some embodiments, user access platform 1110 includes a weight sensor or presence sensor (e.g., a sensor identical or substantially similar to container presence sensor 867, described above with reference to FIG. 20). In some embodiments, the presence sensor utilizes infrared technology. In other embodiments, the presence sensor may include a limit switch configured to be actuated when the container 1118 is deposited on the user access platform 1110.

Figure 27:
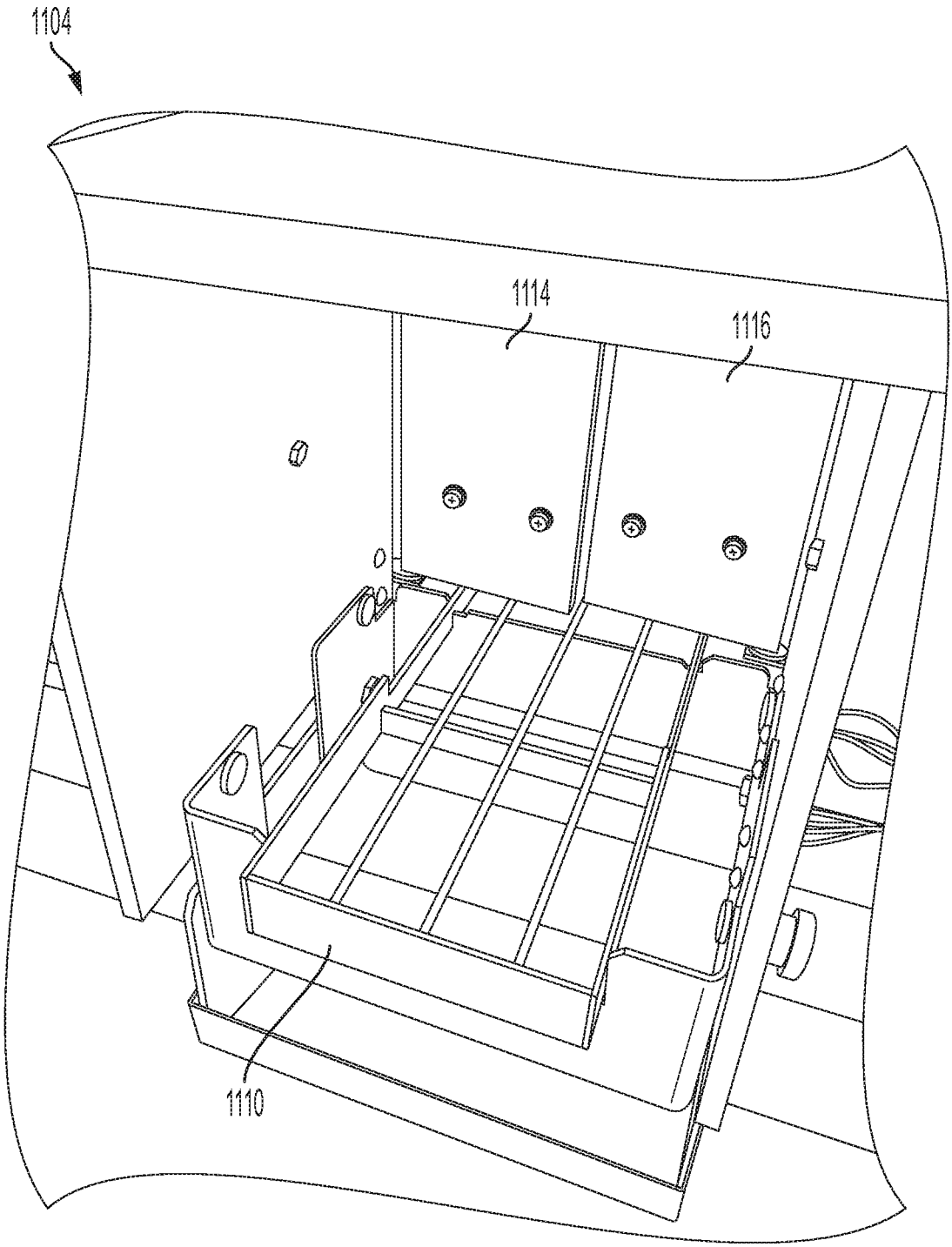
FIG. 27 is a perspective view of the user access platform portion of the vending machine of FIG. 23.

Referring now to FIG. 27, a view of the user access station 1104 with the vending machine housing 1102 removed is shown, according to an exemplary embodiment. As shown and as described above, the first swinging door 1114 and the second swinging door 1116 are biased to remain in a closed position. In an exemplary embodiment, the swinging doors 1114 and 1116 are not connected to an actuating mechanism. Instead, the force of a pusher arm is sufficient to cause the swinging doors 1114 and 1116 to pivot outwards and permit passage of the container 1118 into the user access station 1104. FIGS. 23-27 depict the swinging doors 1114-1116 at the rear of the user access station 1104, with the pusher arm configured to move the container 1118 from a rear portion of the user access platform 1110 to a front portion of the user access platform 1110, where the front portion is near the user access door 1108.

Figure 28:
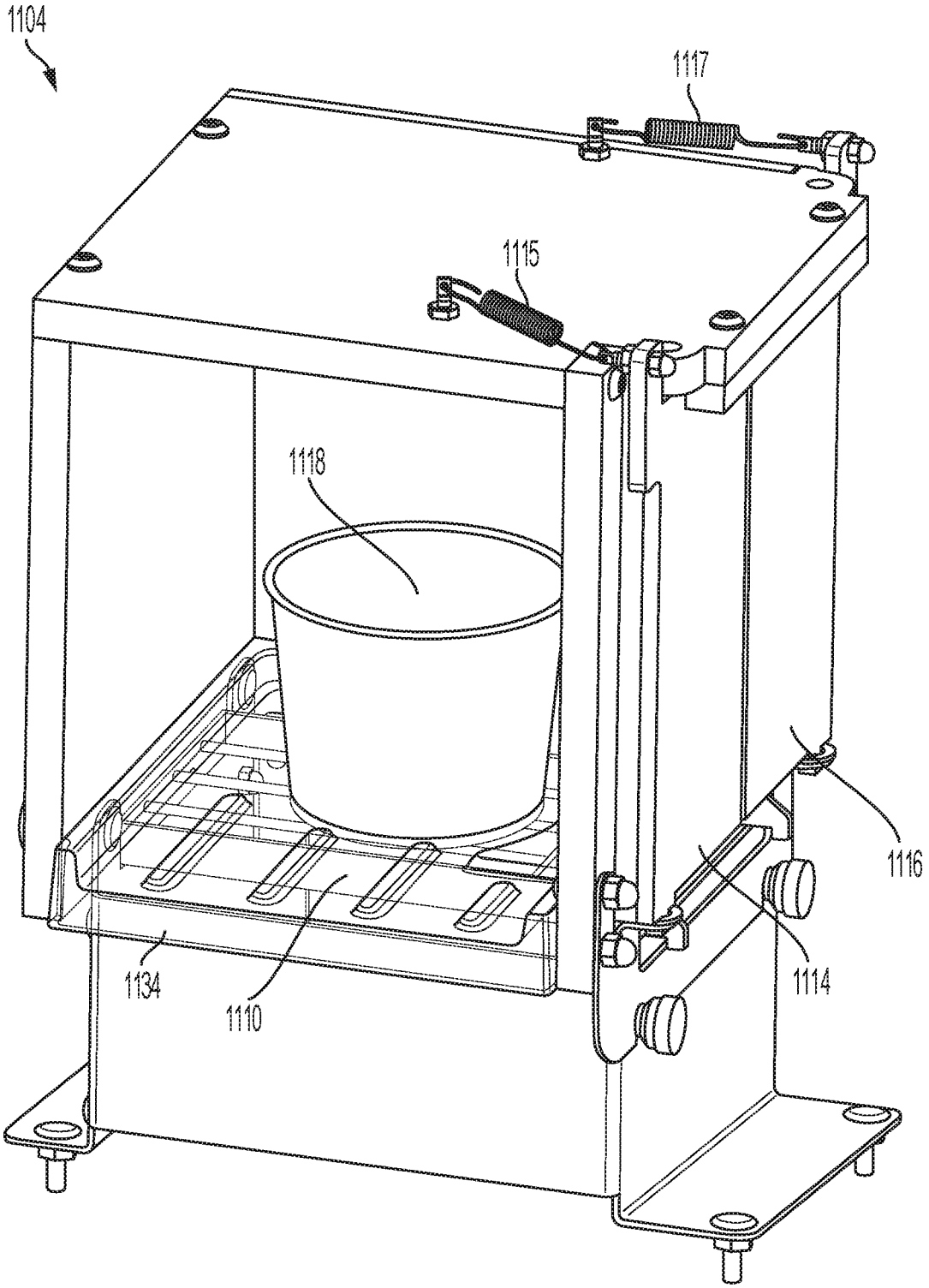
FIG. 28 is a perspective view of a user access platform portion of the vending machine of FIG. 23.
Figure 30:
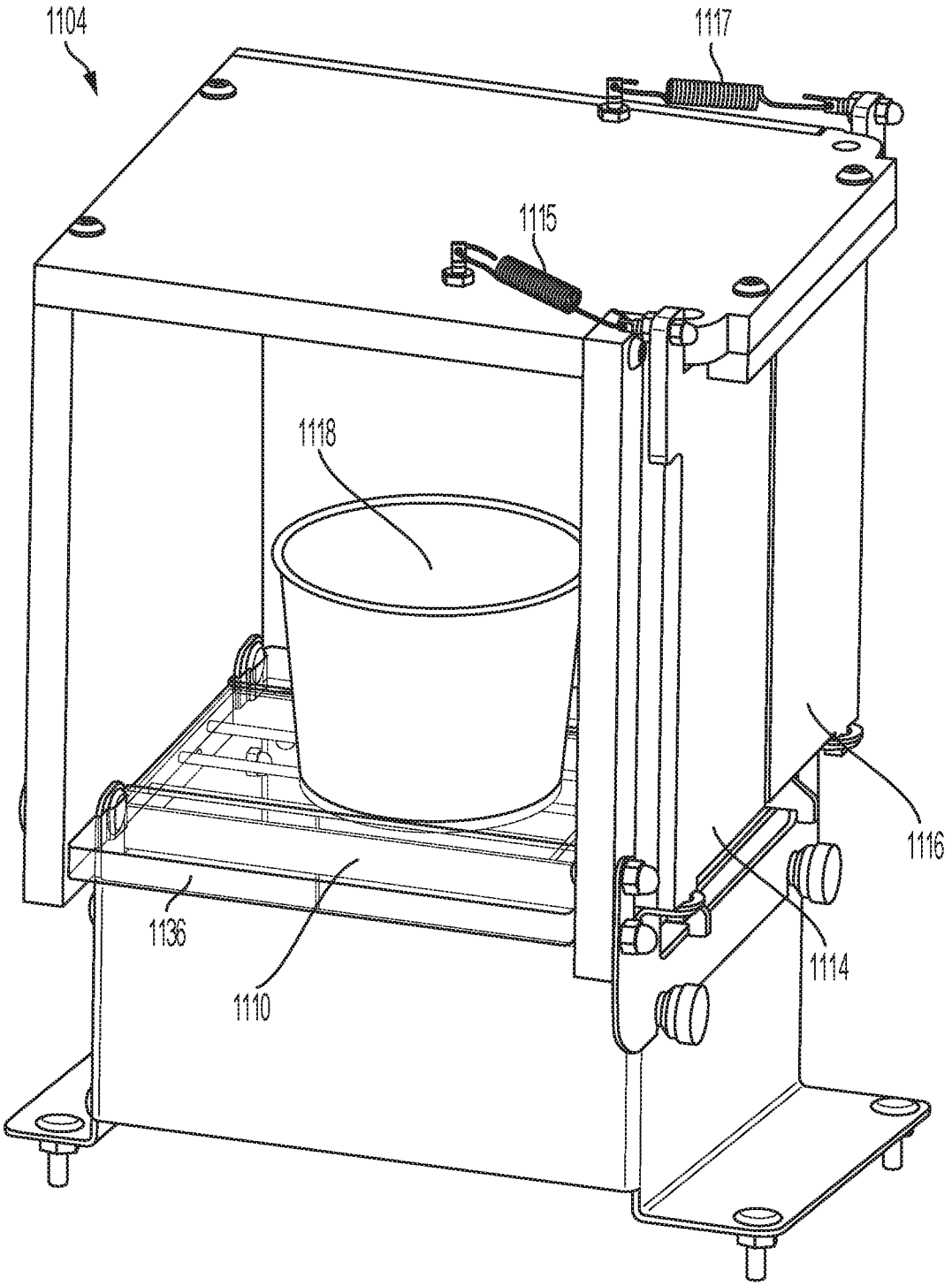
FIG. 30 is a perspective view of a user access platform portion of the vending machine of FIG. 23.

However, in other embodiments including those depicted in FIGS. 28 and 30, the user access station 1104 may be configured such that the swinging doors 1114 and 1116 are located at the right or left side of the user access station 1104, such that the pusher arm moves in a rightward direction or a leftward direction relative to the user access platform 1110 to deposit the container 1118 onto the user access platform 1110. As shown, the swinging doors 1114 and 1116 may not be connected to an actuating mechanism as the force of the pusher arm may be sufficient to cause the swinging doors 1114 and 1116 to pivot to permit passage of the container 1118 into the user access station 1104. Springs 1115 and 1117 may be disposed at the top of the user access station 1104 to bias the swinging doors 1114 and 1116 to remain in a closed position in the absence of the pusher arm. In some embodiments, a robotic arm may be used to deposit the container 1118 onto the user access platform 1110 instead of a pusher arm. For example, the robotic arm may include multiple points of articulation and may be configured to move in and rotate about multiple axes in order to grasp the container 1118 and place it on the user access platform 1110.

FIGS. 28 and 30 also depict the user access station 1104 with a landing pad between the user access platform 1110 and the container 1118. For example, FIG. 28 depicts a user access station 1104 with a silicone landing pad 1134, while FIG. 30 depicts a user access station 1104 with an acrylic landing pad 1136. In other embodiments, the landing pad may be fabricated from any other suitable material. The landing pad may serve a variety of functions. For example, the landing pad may serve as a barrier against the intrusion of insects or debris into the vending machine housing 1102, ensuring that the frozen food product dispensed by the machine remains sanitary. The landing pad may also protect the vending machine housing 1102 against any drips or spills caused by melting frozen food product as the container 1118 is removed from the user access station 1104. The landing pad may be removable from the user access station 1104, thus facilitating easy cleanup of drips and spills.

Figure 29:
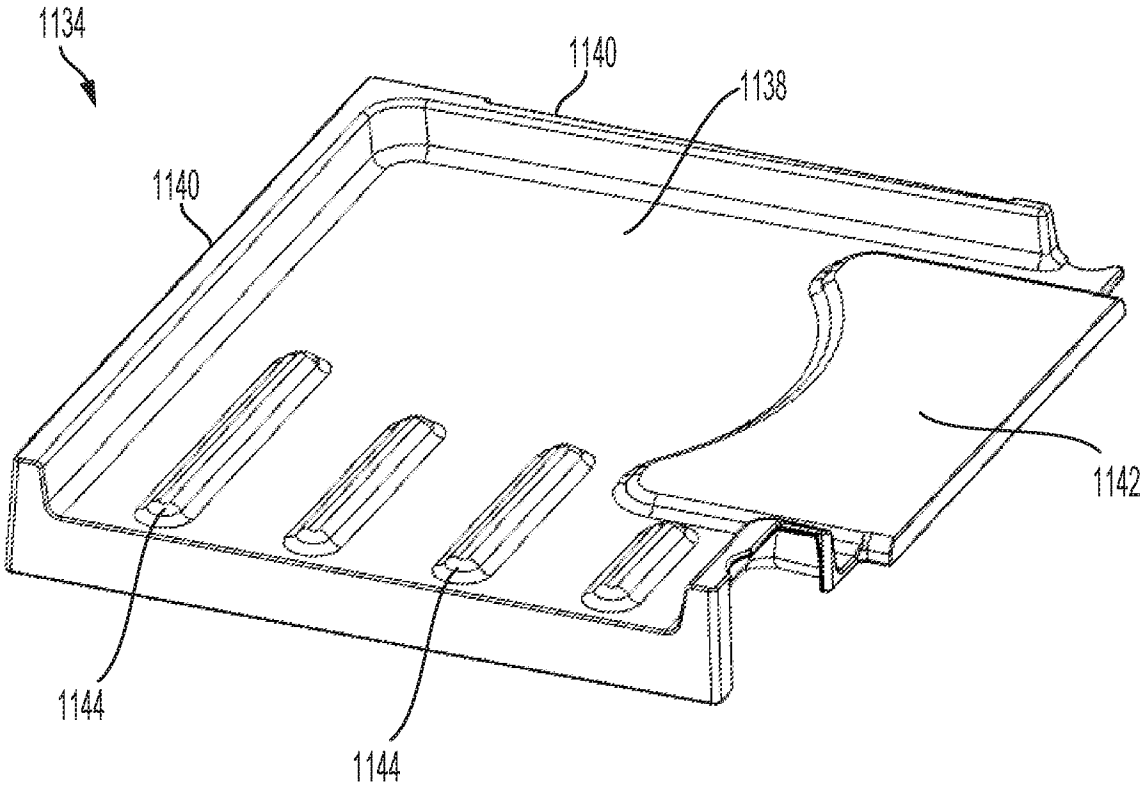
FIG. 29 is a perspective view of the silicone landing pad portion of the vending machine of FIG. 23.
Figure 31:
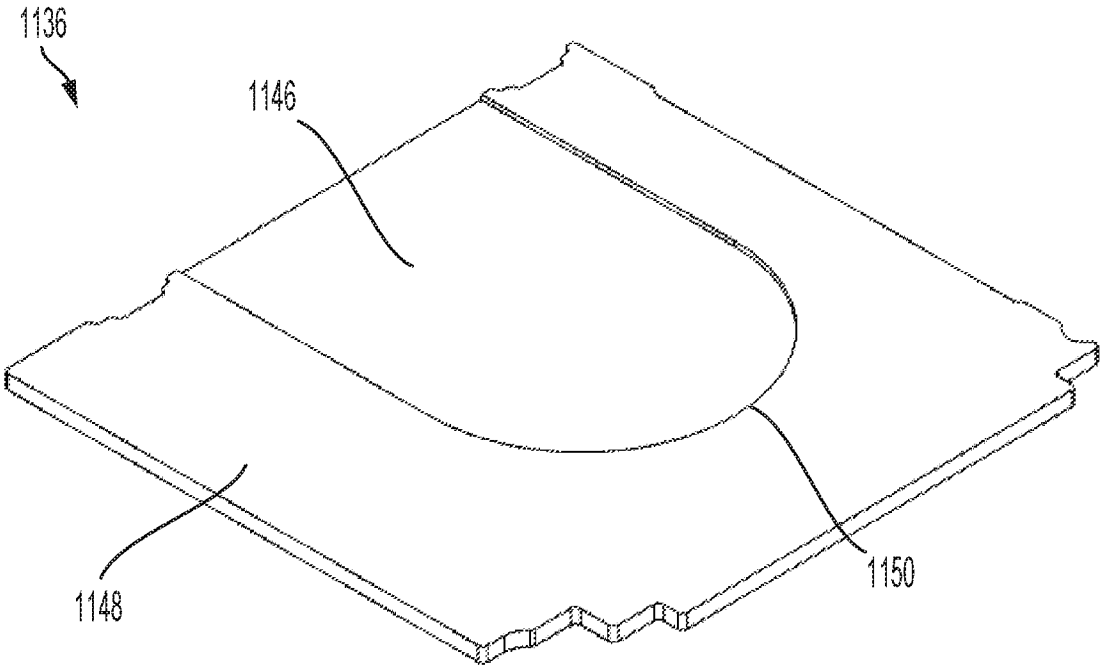
FIG. 31 is a perspective view of the acrylic landing pad portion of the vending machine of FIG. 23.

Referring specifically to FIG. 29, the silicone landing pad 1134 is shown, according to an exemplary embodiment. In some embodiments, the silicone landing pad 1134 may be fabricated using a molding process. Silicone landing pad 1134 is shown to include a container depositing region 1138 surrounded on one or more sides by a peripheral wall 1140 and raised regions 1142, 1144. When installed in the user access station 1104, raised region 1142 may be situated proximate the swinging doors 1114, 1116, while regions 1144 may be situated at the front of the user access platform 1110 near the user access door 1108. In some embodiments, the raised regions 1142, 1144 may function as bumpers to ensure that the container 1118 is deposited in an ideal location for dispensing (i.e., clear of both the swinging doors 1114, 1116 and the access door 1108). Referring now specifically to FIG. 31, the acrylic landing pad 1136 is shown, according to an exemplary embodiment. In some embodiments, the acrylic landing pad 1136 may be fabricated using a machining process. The acrylic landing pad 1136 is shown to include a container depositing region 1146 surrounded by a raised region 1148. In some embodiments, container depositing region 1146 may include an arc-shaped wall 1150 that is situated proximate the swinging doors 1114, 1116 when the acrylic landing pad 1136 is installed in the user access station 1104, although in other embodiments, container depositing region 1146 may have any desired geometry to ensure that the container 1118 is deposited in an ideal location for dispensing.

Figure 32:
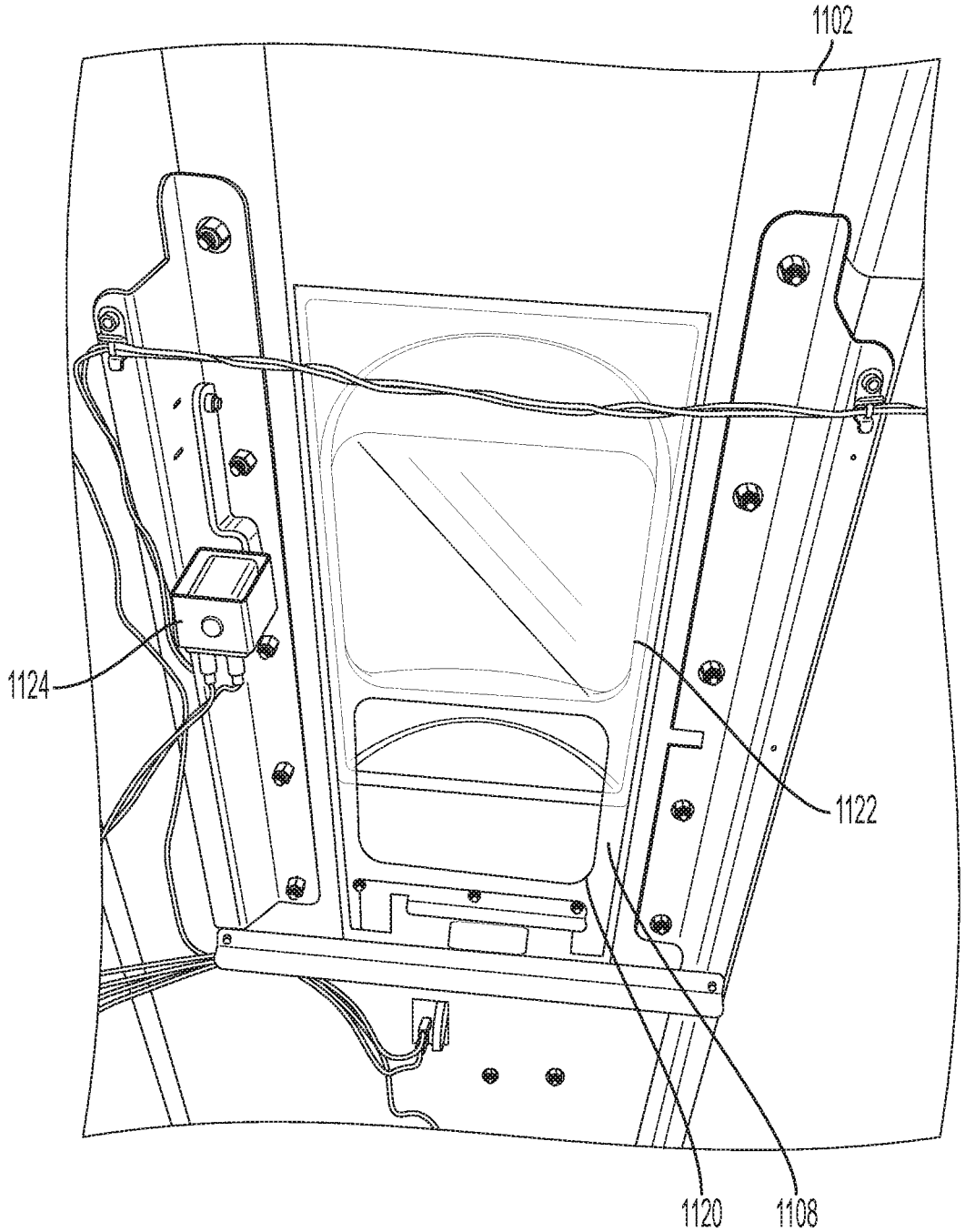
FIG. 32 is a perspective view of the delivery door portion of the vending machine of FIG. 23.
Figure 33:
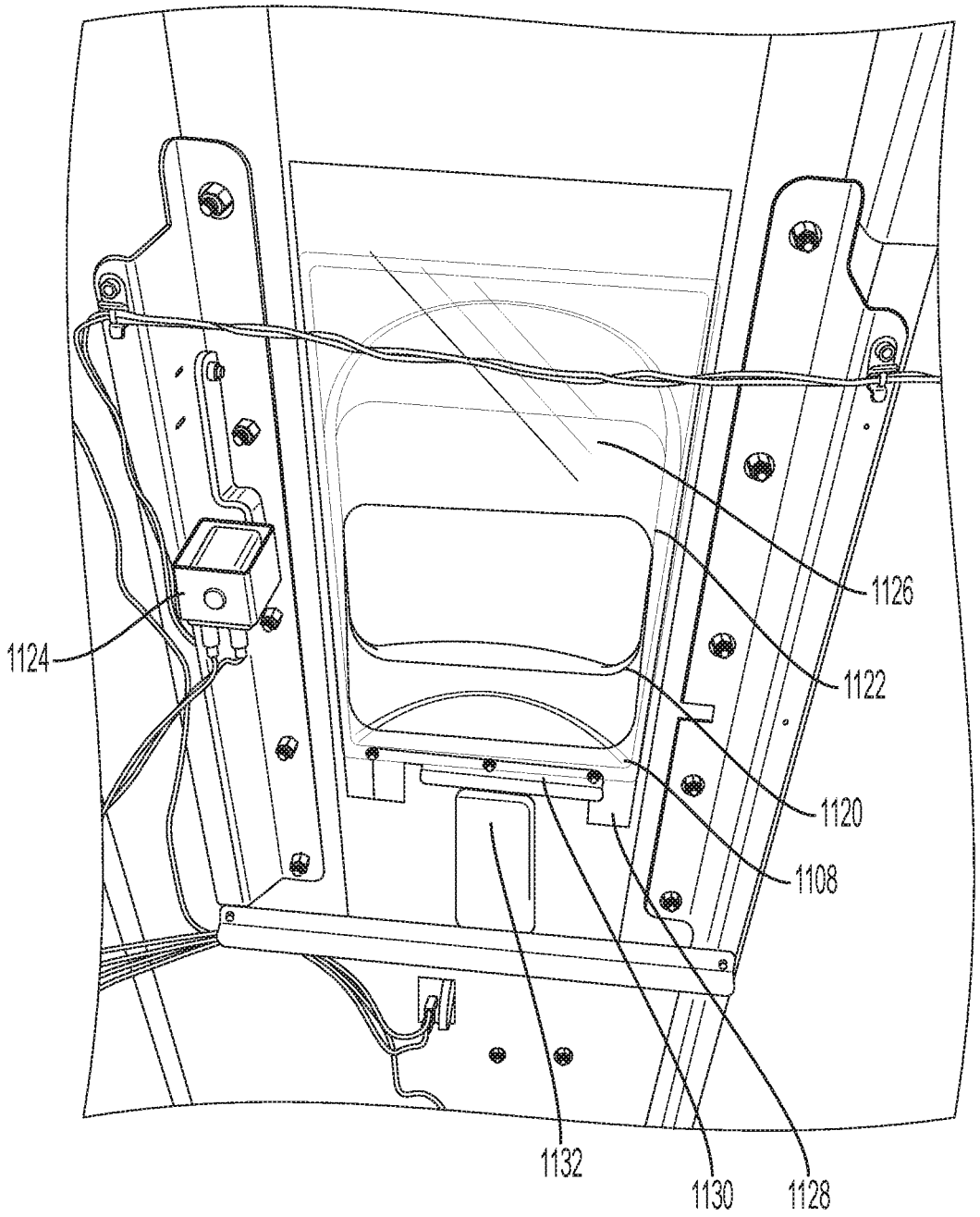
FIG. 33 is a perspective view of the delivery door portion of the vending machine of FIG. 23.
Figure 34:
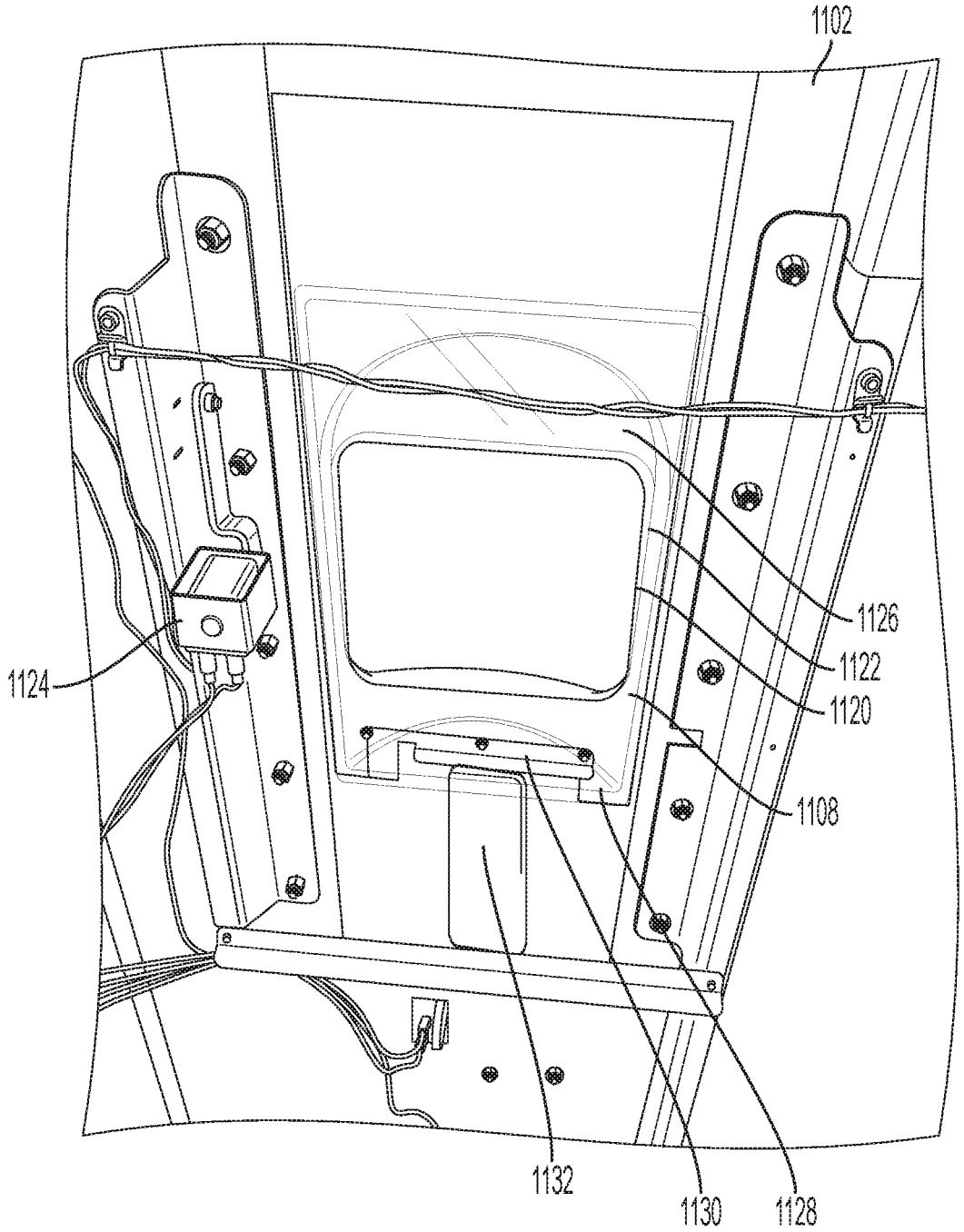
FIG. 34 is a perspective view of the delivery door portion of the vending machine of FIG. 23.

Referring now to FIGS. 32-34, views of the user access door 1108 from the interior of the vending machine 1100 are shown, according to an exemplary embodiment. As shown in FIG. 32, the user access door 1108 is normally biased by gravity to return to a closed position (or down position) such that the access door opening 1120 is located below opening 1122 in housing 1102. A solenoid driven lock 1124 engages with the user access door 1108 to retain the door 1108 in the closed position. In other embodiments, different types of locks may be utilized. As shown in FIGS. 33-34, the user access door 1108 includes an upper portion 1126 and a lower portion 1128. When the user access door 1108 is in the closed position, the upper portion 1126 is aligned with opening 1122 to block access to the user platform 1110. When the user access door 1108 is in the open position, the lower portion 1128 is aligned with opening 1122 to permit access to the user access platform 1110. In various embodiments, the upper portion 1126 and the lower portion 1128 of user access door 1108 may be fabricated from transparent plastic, acrylic, or any other suitable material. The user access door 1108 is further shown to include a door stop or push bar 1130. In various embodiments, the door stop 1130 may be fabricated from metal (e.g., steel, aluminum, or iron angle stock), or it may be fabricated from the same material as the upper portion 1126 and the lower portion 1128.

An actuator 1132 is configured to contact the door stop 1130 and push the user access door 1108 vertically upwards until the access door opening 1120 in lower portion 1128 is aligned with opening 1122. Once the access door opening 1120 is fully aligned with opening 1122 (as depicted in FIG. 34), the solenoid lock 1124 engages to retain the user access door 1108 in the open position (or up position). The actuator 1132 is further configured to drive the user access door to the closed position. In some embodiments, the actuator 1132 returns to the closed position at a slower rate of travel than the rate of travel utilized to drive the user access door 1108 to the open position. In some embodiments, the slower rate of travel may ensure that the door stop 1130 remains in contact with the actuator 1132 as the user access door 1108 travels from the open position to the closed position. If the solenoid lock 1124 fails (e.g., due to a loss of power) and the actuator 1132 is in the closed position, gravity causes the user access door 1108 to drop from the open position to the closed position (as depicted in FIG. 32). The weight of the door 1108 is not sufficiently large to risk harm to persons or objects in the path of the door 1108 (e.g., a user that is retrieving a container 1118 from the user access station 1104) as it travels from the open position to the closed position, even when doing so solely under the influence of gravity.

In some embodiments, the vending machine 1100 further includes a door detection sensor, which may be a limit switch, infrared proximity sensor, or other suitable object presence sensor. The limit switch may be configured to act as a redundant safety system by sensing when the user access door 1108 is within a configurable distance (e.g., 1 inch) of the closed position. During normal operation, the actuator 1132 moves in a closing (i.e., downward) direction until it reaches the same configurable distance from its fully closed position. The actuator 1132 then halts and awaits the arrival of the access door 1108 at the limit switch before continuing its travel to the fully closed position. This arrangement may prevent a "free fall" condition of the access door 1108 that may be startling to an unsuspecting user. For example, the access door 1108 may be traveling in a downward direction due to gravity when it encounters a condition which causes the access door 1108 to stick in position and then release unexpectedly. The presence of the limit switch ensures that the access door 1108 will always momentarily pause in a semi-open position before reaching its fully closed position.

Returning to FIG. 21, in some embodiments, processing electronics 632 are configured to drive the sliding access door 1108 as depicted in FIGS. 23-34. Memory 905 may include user access station module 950. User access station module 950 may be configured to actuate a pusher arm to transfer a container 1118 through the first swinging door 1114 and the second swinging door 1116 to user access platform 1110. User access station module 950 may be configured to detect the presence of a container 1118 on user access platform 1110 via an input from a sensor (e.g., a weight sensor, an infrared presence sensor). In response to detection of the presence of a container 1118 on user access platform 1110, user access station module 950 may be configured to provide an output to move user access door 1108 from a closed position to an open position. User access station module 950 may be further configured to provide an output to engage solenoid lock 1124 to retain the user access door 1108 in the open position.

Returning now to FIG. 22, in some embodiments, the method 1000 of operating the automated frozen food product vending machine includes operation of the sliding access door 1108. After receiving all of the selected toppings, the container including the dispensed frozen food product and toppings is presented to the user for consumption (step 1030). In some embodiments, the pusher arm moves from a retracted position to an extended position, passing through the first swinging door and the second swinging door, thereby moving the now-finished product to the user access platform. The pusher arm contacts the container to move the finished product from the second movable platform to the user access platform. The sensor of the user access platform determines the presence of the finished product and confirms that it has been successfully transferred by the pusher arm. The user access door is driven from a closed position to an open position in which the user may access the completed product through the user access door. Before the user access door is driven into the open position, the user cannot reach through the user access door into the interior of the vending machine.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show or the description may provide a specific order of method steps, the order of the steps may differ from what is depicted. Also two or more steps may be performed concurrently or with partial concurrence. Such variation will depend on various factors, including software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A delivery door system for use with a vending machine, comprising:

a user access platform;

a user access door located adjacent to the user access platform and configured to be vertically driven between a closed position and an open position;

an actuator; and a lock configured to engage the user access door to retain the user access door in the closed position and the open position, wherein the user access door is configured to return to the closed position via gravity when the lock is unlocked and the actuator is in a down position.

2. The delivery door system of claim 1, wherein the user access door includes an upper portion and a lower portion with an opening formed in the lower portion;

wherein the upper portion is aligned with a vending machine housing opening when the user access door is in the closed position to block access to the user access platform; and wherein the lower portion is aligned with the vending machine housing opening when the user access door is in the open position to permit access to the user access platform.

3. The delivery door system of claim 1, wherein the actuator is configured to be driven upwards to move the user access door to the open position at a higher speed than the user access door is configured to be driven downwards to the closed position.

4. The delivery door system of claim 1, further comprising a landing pad located on top of the user access platform.

5. The delivery door system of claim 4, wherein the landing pad is fabricated from acrylic or silicone.

6. A delivery door system for use with a vending machine, comprising:

a user access platform;

an actuator;

a user access door located adjacent to the user access platform and configured to be vertically driven between a closed position and an open position, wherein the user access door includes a stop configured to be contacted by the actuator to move the user access door between the closed position and the open position; and a first swinging door and a second swinging door adjacent to the user access platform, wherein the user access platform is positioned between the first swinging door and the second swinging door.

7. A delivery door system for use with a vending machine, comprising:

a user access platform;

a user access door located adjacent to the user access platform and configured to be vertically driven between a closed position and an open position; and a user indicator light located below the user access platform, the user indicator light configured to illuminate in at least one color corresponding to a step in an automated vending process.

8. A delivery door system for use with a vending machine, comprising:

a user access platform;

a user access door located adjacent to the user access platform and configured to be vertically driven between a closed position and an open position; and a first swinging door and a second swinging door adjacent to the user access platform, wherein the user access platform is positioned between the first swinging door and the second swinging door.

9. An automatic frozen food product vending machine, comprising:

a frozen food product dispensing station for dispensing at least one frozen food product into a frozen food product container;

an arm movable to transfer the dispensed frozen food product container to a user access platform;

a user access door located adjacent to the user access platform and configured to be vertically driven between a closed position and an open position; and an actuator configured to be driven upwards to move the user access door to the open position at a higher speed than the user access door is configured to be driven downwards to the closed position.

10. An automatic frozen food product vending machine, comprising:

a frozen food product dispensing station for dispensing at least one frozen food product into a frozen food product container;

an arm movable to transfer the dispensed frozen food product container to a user access platform; and a user access door located adjacent to the user access platform and configured to be vertically driven between a closed position and an open position, the user access door including an upper portion and a lower portion with an opening formed in the lower portion;

wherein the upper portion is aligned with a vending machine housing opening when the user access door is in the closed position to block access to the user access platform; and wherein the lower portion is aligned with the vending machine housing opening when the user access door is in the open position to permit access to the user access platform.

11. The automatic frozen food product vending machine of claim 10, further comprising a lock configured to engage the user access door to retain the user access door in the closed position and the open position.

12. The automatic frozen food product vending machine of claim 10, further comprising a user indicator light located below the user access platform, the user indicator light configured to illuminate in at least one color corresponding to a step in an automated frozen food vending process.

13. The automatic frozen food product vending machine of claim 10, further comprising a first swinging door and a second swinging door adjacent to the user access platform.

14. The automatic frozen food product vending machine of claim 13, wherein the arm is configured to cause the first swinging door and the second swinging door to pivot outwards to permit the arm to transfer the dispensed frozen food container to the user access platform.

15. The automatic frozen food product vending machine of claim 14, wherein the first swinging door and the second swinging door are located proximate a rear portion of the user access platform, and wherein the arm is movable from the rear portion of the user access platform to a front portion of the user access platform proximate the user access door.

16. The automatic frozen food product vending machine of claim 14, wherein the first swinging door and the second swinging door are located proximate a side portion of the user access platform, and wherein the arm is movable in a rightward direction or a leftward direction relative to the user access platform.

17. The automatic frozen food product vending machine of claim 10, further comprising an actuator.

18. The automatic frozen food product vending machine of claim 17, wherein the user access door further includes a stop configured to be contacted by the actuator to move the user access door between the closed position and the open position.

19. The automatic frozen food product vending machine of claim 17, further comprising a lock configured to engage the user access door to retain the user access door in the open position, wherein the user access door is configured to return to the closed position via gravity when the lock is unlocked and the actuator is in a down position.

20. The automatic frozen food product vending machine of claim 10, further comprising a landing pad located on top of the user access platform.

21. The automatic frozen food product vending machine of claim 20, wherein the landing pad is fabricated from acrylic or silicone.

* * * * *